US008056237B1

(12) United States Patent
Candler et al.

(10) Patent No.: US 8,056,237 B1
(45) Date of Patent: Nov. 15, 2011

(54) GUARDRAIL STANCHION AND SYSTEM

(75) Inventors: Lewis Candler, Dallas, WI (US); Wesley Wiedenbeck, Eleva, WI (US); Anthony J. Bourget, Eau Claire, WI (US)

(73) Assignee: OuiCanDuit, LLC, Eau Claire, WI (US)

( * ) Notice: Subject to any disclaimer, the term of this patent is extended or adjusted under 35 U.S.C. 154(b) by 220 days.

(21) Appl. No.: 12/014,896

(22) Filed: Jan. 16, 2008

(51) Int. Cl.
*B23P 17/00* (2006.01)

(52) U.S. Cl. ..... 29/897.34; 29/897; 29/525.01; 29/525.02; 29/428; 52/127.1; 52/698; 182/113; 256/59

(58) Field of Classification Search ..... 29/897.34, 29/525.01, 525.02, 428, 897, 460, 527.1, 29/897.33, 879.34, 458, 527.2; 52/127.1, 52/698; 182/113; 256/24, 52, 59; 249/43
See application file for complete search history.

(56) References Cited

U.S. PATENT DOCUMENTS

| | | | | | |
|---|---|---|---|---|---|
| 917,083 | A | * | 4/1909 | Kyle | 256/52 |
| 2,019,195 | A | * | 10/1935 | Simpson | 249/43 |
| 3,439,898 | A | | 4/1969 | Cleveland et al. | |
| 3,589,682 | A | | 6/1971 | Dickey | |
| 3,662,993 | A | | 5/1972 | Lionetto | |
| 3,863,900 | A | | 2/1975 | Dagiel et al. | |
| 3,881,698 | A | | 5/1975 | Marsh | |
| 3,995,834 | A | | 12/1976 | Melfi | |
| 4,015,827 | A | | 4/1977 | Brand | |
| 4,364,546 | A | * | 12/1982 | Lyman et al. | 256/24 |
| 4,383,676 | A | * | 5/1983 | Souza, Jr. | 256/59 |
| 4,669,577 | A | | 6/1987 | Werner | |
| 4,872,298 | A | * | 10/1989 | Klemic, Jr. | 52/127.1 |
| 4,896,864 | A | | 1/1990 | Nusbaum | |
| 4,909,483 | A | | 3/1990 | van Herpen | |
| 5,377,958 | A | | 1/1995 | Palmer | |
| 5,560,588 | A | | 10/1996 | Hilliard | |
| 6,053,281 | A | * | 4/2000 | Murray | 182/113 |
| 6,270,057 | B1 | | 8/2001 | Highley et al. | |
| 6,547,223 | B1 | | 4/2003 | Letourneau | |
| 7,234,689 | B2 | | 6/2007 | Kuenzel | |
| 7,637,071 | B2 | * | 12/2009 | Pryor | 52/698 |

* cited by examiner

*Primary Examiner* — Richard Chang
(74) *Attorney, Agent, or Firm* — Anthony J. Bourget

(57) ABSTRACT

A guardrail system and method comprises utilizing at least one through-hole of a poured concrete wall of a structure to affix a stanchion to the wall inside a bay of the structure. The stanchion allows for a guardrail to be conveniently and securely positioned within the bay without damage to the structure and without covering an edge of the structure. A fastener inserts through the through-hole which is preferably a pre-existing tie-hole resulting from formation of the wall. In one optional aspect a guardrail stanchion includes a base segment having at least two slots for receiving fasteners which insert through two tie-holes of the wall, and at least one side segment having at least one adjustment port, the side segment extending generally perpendicular to the base segment. A pair of stanchions may be affixed to opposing walls within the bay, and guardrails affixed thereto and spanning across the bay. The system may also include a cable system having a cable operate as a guardrail to be tightened by utilizing a stanchion in accordance with the invention.

32 Claims, 13 Drawing Sheets

GUARDRAIL STANCHION AND SYSTEM

BACKGROUND

1. Field of the Invention

The present invention relates generally to guardrail stanchions, guardrail systems and methods of affixing stanchions, and more specifically to stanchions, guardrail systems and methods for use on construction sites, and particularly to stanchions, guardrail systems and methods for use on concrete structures.

2. Background Information

Several guardrail devices are known that allow for safety protection at the edge of a construction, such as guardrails placed to prevent workers or objects from falling off the edge of a building under construction. Some form of protective barrier or guardrail is usually required around the edges of the workplace. Detailed regulations are established by various bodies designed to eliminate or reduce workplace hazards. Organizations such as the Occupational Safety and Health Administration (OSHA) in the United States and various state agencies, Workmen's Compensation Boards and trade organizations often require some form of barrier protection in the workplace. Even if OSHA or other regulatory bodies do not require such systems, or where requirements for barrier protection are lax or less stringent (such as may be the case from jurisdiction-to-jurisdiction or country-to-country), insurance companies would insist upon the best safety or provide incentives for use of best practices.

In the United States, OSHA has established construction standards for guarding open-sided floors and roofs, including erection of a "standard railing", which comprises a top rail, intermediate rail, toeboard and posts, to enclose such open spaces. The top rail is required to have a vertical height of approximately 42 inches from the upper surface of the top rail to the floor, platform, runway or the like being protected. The intermediate rail is specified to be halfway between the top rail and the floor, etc., while the toeboard is required to be at least 4 inches in vertical height from its top edge to the level of the floor, platform, etc. In addition, the toeboard must be securely fastened in place and must be flush with the floor such that not more than a ¼-inch clearance exists between the toeboard and the floor. An assembly so constructed is sometimes referred to as a "standard railing".

Various attempts have been made to provide construction guardrail systems, some of which may or may not be considered "standard railings". One such guardrail system involves use of a support stanchion as shown in U.S. Pat. No. 4,015,827 issued to Brand on Apr. 5, 1977, for supporting a life line around the perimeter of an elevated area such as a building roof. The stanchion is anchored to the roof or building support by bolts or screws embedded into the floor. Another system includes use of a support as shown in U.S. Pat. No. 5,560,588, issued to Hilliard, for a temporary guard railing erected along the edges of open floors, balconies, stairs, and the like in a building under construction. This device is secured to the floor surface by running screws or other male connectors through the support and into the floor surface. Connecting devices to the floor of a structure, such as by nailing a standard or stanchion to a concrete floor results in damage to the floor, often requiring expensive or time-consuming repair, among other problems.

Further safety railing systems or stanchions for concrete slab walls are shown in U.S. Pat. No. 5,377,958 to Palmer, and U.S. Pat. No. 6,547,223 to Letourneau. The device in Palmer involves vertically extending stanchion members mounted to wall brackets, which the brackets in turn are mounted below the exterior facia of the wall by fasteners driven through the brackets into the underlying wall structure. The device in Letourneau involves a railing that engages in a cavity of an anchor where the anchor is rigidly mounted into the concrete wall panel at a face or end of the floor slab. Here again, such systems have fasteners that are driven into or imbedded within the concrete or floor structure. These systems also cover an edge area of the flooring which must be removed in order finish the edge or the areas adjacent the edge.

A further system as shown in U.S. Pat. No. 6,270,057 issued to Highley et al., involves a system for use on a structure where concrete is poured upon corrugated material. The reusable multi-story building construction guardrail system includes a bar element bolted to an outside of a frame member that forms the outer perimeter of a conventional elevated slab floor support structure consisting of I-beam floor joists and trusses that serve to support horizontal floor supports and the corrugated floorplan thereabove onto which concrete is poured in order to form an elevated concrete slab floor surface in a multi-story building. The protection system is bolted directly to the perimeter frame member or support structure upon which the concrete is poured. Yet a further system as shown in U.S. Pat. No. 4,909,483 to van Herpen involves a handrail support which is kept in place by a weight element placed upon a base. The simplicity and usefulness of the present invention in this application is neither taught nor suggested by these mechanisms.

A number of guard rail mechanisms for which patents have been granted, also relate to the slab-grabber or clamping variety. Some examples of such devices are found in U.S. Pat. No. 4,669,577 to Werner; U.S. Pat. No. 3,995,834 to Melfi; U.S. Pat. No. 3,881,698 to Marsh; U.S. Pat. No. 3,863,900 to Dagiel et al.; and, U.S. Pat. No. 7,234,689 to Kuenzel. These devices are typically clamped to the edge of a slab of the construction. They generally mimic a C-clamp mechanism which compresses upon the top and bottom sides of a slab, while also covering an edge portion of the slab to which the clamp is attached. While the clamping action avoids damage to the floor element, being that it is attached at the edge necessarily requires a subsequent movement of the device in order to work on the structure at that edge of the slab. The simplicity, reliability and usefulness of the present invention in this application in not taught nor suggested by these slab grabber mechanisms.

Various other mechanisms for which patents have been granted relate to other types of compression-fit or friction-fit mechanisms. An example of such device is found in U.S. Pat. No. 3,662,993 to Lionetto. In such application, posts span from the floor to ceiling and are fastened into position with jacks or threaded bars. While such mechanisms generally avoid direct damage to the floor or structure, and also avoid placement or coverage over the edge of the slab, the reliability of such compression-fit mechanisms is questioned. Natural or unnatural changes, such as expansion or contraction of the structure materials, present concern due to slippage of the devices from a secured safety position within the bay of the structure. Similar expansion or contraction or other changes to the device itself may also occur. The material used for the device is different than the concrete or other material that is used for the structure, and the expansion and contraction characteristics are different such that the materials expand and/or contract at different rates. Such differences in the material characteristics of the device and structure present further variability issues for the stability of a compression-fit system. As the structure or device expands or contracts, the compression-fit forces are changed. The changed forces may cause the device to break, or to slip or weaken its fit against the structure, or if the device does not yield, in an extreme case the structure may shift or crack. In some instances a post is also used as (or has the effect of being used as) a shoring or re-shoring device. A shoring device is commonly understood to be a device which supports or holds the form or deck, as opposed to a re-shoring device which holds or supports the resulting concrete structure. In either case, the expansion of the device might lift the ceiling slightly, thereby causing other posts or shoring devices to loose their compression fit. In some cases the posts fall from position and are otherwise unworkable as a safety device. In sum, the compression-fit devices having a post span from floor to ceiling are inherently suspect and unworkable for use in a safety role. By the same token, compression-fit posts that span from wall-to-wall are also unworkable.

Other friction-fit mechanisms for which patents have been granted include U.S. Pat. No. 3,589,682 to Dickey granted Jun. 29, 1971, and U.S. Pat. No. 3,439,898 to Cleveland et al granted Apr. 22, 1969. Dickey says that the general practice at the time in erection of such safety fences involved use of lengths of 2-by-4 lumber cut to approximately the spacing between the floor and ceiling, and wedged into place in any expedient manner. One or more horizontal rails were commonly nailed to such vertical pieces of lumber to construct a crude fence. In practice it was found that the wedging of such vertical pieces of lumber can never be made completely secure and the lumber will rapidly dry out, being exposed to very severe weathering, and will become loose and sometimes blow away altogether causing an additional hazard to persons standing below. The same thing can occur merely because the concrete itself dries out and will shrink very slightly thereby causing such vertical pieces of lumber to become loose and fall (or in other cases, cause the lumber to tighten or result in bowing or nail pulls). The appearance of the otherwise safe structure may cause a false sense of security, further exacerbating the hazard. Dickey uses a telescoping column for erection of a safety fence or guardrail at a building under construction. A manually operable jacking system is used for extending the column and forcing upper and lower pads firmly against the ceiling and floor of the building to hold the column firmly in position. Cleveland also shows a compression-fit safety barrier and barrier fence having telescoping columns. Such telescoping compression-fit systems may be positioned so as to not obstruct the edge of the flooring and may reduce the potential for direct damage to the structure (such as damage that might otherwise be caused by nailing). However, such systems lack the simplicity and reliability of the present invention. They also are subject to variables encountered with material expansion as noted above, and thus are suspect and unreliable for a safety role. Further, improvements are always desired in any art. Other drawbacks of such friction-fit mechanisms include the cost of having columns span from floor-to-ceiling or having expensive threaded components or other means for telescoping action. Precautions are also required to prevent screw-type mechanisms to not loosen, or such mechanisms may require a special tool such as a wrench or other tool to set-up or extend the apparatus for a friction fit. The size of the floor-to ceiling mechanisms are bulky and often troublesome to transport and/or store. Further, the over-tightening of a post or column may result in damage to the floor or ceiling and corresponding loosening of adjacent posts or columns. Such mechanisms are generally troublesome to set-up.

Disadvantageously, while the above and other past approaches may be sufficient in some respects for their particular purposes, each has deficiencies. Some of the approaches require a considerable effort in set-up and take-down; or still result in damage to the structure (such as by nailing, which commonly requires drilling or use of a hammerdrill or other aggressive tools) which in turn requires additional expense, delay and labor for correction; or connect adjacent to, or cover up, the edge of the structure thus requiring subsequent movement in order to work on or at the edge location; or rely on a compression or friction fit which is susceptible to slippage and other troubles as mentioned. Further, with such approaches there is an ever-present uncertainty as to whether the systems are indeed compliant with OSHA or other requirements, or if initially compliant, whether they can maintain compliance and be safe throughout the construction effort. Since the temporary safety mechanisms are typically repeatedly moved in order to undertake construction efforts, workers (and the owners of the structures) must be diligent in assuring that the systems continue to be safe. Even if some of the prior systems comprise a "standard railing" and/or guardrail system that securely connects to the structure without nailing or other damage to the structure, they are either of a compression-fit variety, or disadvantageously cover the edge location of the flooring.

The known guardrail devices are often complicated, expensive, typically result in damage to the structure to which they are affixed, are difficult to secure, and are susceptible to non-compliance with OSHA. Many are not reusable, many are limited to a particular site configuration, require temporary removal and re-setting when a forklift needs access, are in the way when working on an outside edge of the structure (such as when laying brick or pouring outside edge wall or constructing outside edge wall), require the subsequent patching of holes or damage to the structure or require rework of concrete that was damaged by a nail gun or drill or other anchor mechanism. A crew of workers is typically required to assemble guardrails (spending time and labor that could otherwise be devoted to working on the actual structure as opposed to a temporary safety system that will be obsolete upon completion of the construction.

While some of the known guardrail devices are connected to the edge of a concrete deck by friction or grabbing mechanisms, others are mounted into the deck or walls with bolts or nails (or use anchors that are affixed within the structure), or use weights to hold the guardrail adjacent an edge of the deck. Workers will erect one of the many known devices or systems (or cobble together a solution for a given customized fix) and deal with the follow-up or related tasks as needed. For instance, workers will patch holes that were created when nails or other fasteners were removed from the deck. Workers will move a railing from an edge so that the edge area may be cleared for finishing or treated with additional building materials. The railing may be temporarily removed to allow a fork lift to place materials on the deck, and then reassembled or nailed back into position. Workers may also take special care to not lean too hard against a rail held down by weights, or take care not to fasten a life-line to the guardrail, or to undertake one of many other tasks or precautions due to the nature of the known devices or systems.

Damages made to the walls of a structure have become increasingly problematic in recent years especially since owners of the structures sometimes prefer to keep the raw walls exposed to view for aesthetic purposes. Until somewhat recently, drilling into a wall to fasten a board or other safety mechanism was not considered a problem since the walls would typically be covered with paint or sheetrock or other materials. Drilling into the floor or walls or ceilings creates unsightly marks, and the repairs are often unsatisfactory. Further, with a preference for having exposed walls, an emphasis is often placed on positioning conduit within the walls. Thus, drilling into the walls becomes risky. Indeed, safety mechanisms are required to be used on a project, so the workers and owners often have to deal with the competing goals of safety vs. appearance and costs.

SUMMARY

The known guardrail mechanisms indeed have several shortcomings as referenced above. Such shortcomings require extra steps or precautions. Workers and developers or owners of the structures have not so much seen these shortcomings (and the required extra steps or precautions) as problems but, rather, a fact of life or part of the job at hand.

The present inventors, however, have recognized that mounting the guardrail device and related stanchion items adjacent the edge of the deck or other opening of the structure by using means other than a compression-fit that covers the edge, and not having to accommodate for nailing or bolting of the stanchions into the concrete wall or deck, while utilizing a pre-existing feature of the structure that requires little or no extra preparation, planning or expense, would provide numerous benefits. For instance, such a system would enable guardrails to be securely fastened to a bay of a concrete construction without having to subsequently remove the guardrails in order to work on or about the edge of the slab, and would enable fast removal and set-up of a temporary guardrail. Such a system would also avoid damage to the structure otherwise caused by nails or other fasteners, thus lessening or eliminating the need to make expensive or unsightly repairs to the concrete structure. Instead of throwing away a temporary guardrail mechanism that is custom built for each bay, such a system would enable re-use for subsequent projects, and would provide uniformity of guardrail systems from bay-to-bay and project-to-project. Thus, less set-up time and training are required, and waste is reduced. A guardrail system that is easy to set-up or remove, and which requires no additional patching or repair of concrete, reduces labor costs and overall costs of construction. Time and expense otherwise devoted to set-up and maintenance of a temporary safety mechanism an instead be devoted to the tasks of constructing the actual or permanent structure, thus efficiently using resources and multiplying cost savings and speed of construction. In addition, a system that accomplishes these and other tasks while at the same time assisting or assuring compliance with OSHA regulations or insurance or other standards, is especially desired and beneficial. The peace of mind that such a system is safe has a lasting positive impact on workers and the developers or owners of the structure. These and other benefits as recognized by the present inventors are described further below.

The present inventors have also recognized that having a guardrail stanchion also operate as a life-line anchorage would provide further benefits. Traditional guardrail mechanisms have not been secure enough to accommodate such use. Further, OSHA requires that life-line anchorages be independent of any mechanism being used to support or suspend platforms of the structure. Thus, traditional floor-to-ceiling or shoring mechanisms might not be acceptable for use as a life-line anchorage. The mere presence of unstable yet seemingly safe shoring mechanisms may result in an unfortunate instance of a worker unwittingly or improperly using such systems for life-line purposes. Having a guardrail stanchion that also accommodates life-line anchorage thus reduces such risks and also provides a less expensive alternative to traditional anchorage mechanisms.

Heretofore unrelated to the use or set-up of "standard railing" and/or guardrail systems is the formation of the walls of a structure. In common applications, multiple walls together with a deck/ceiling are combined to create a structure having multiple rooms or "bays", such as used for the rooms of a high-rise apartment building or hotel. Known methods for forming a concrete wall include the use and set-up of forms into which is poured concrete which hardens to form a wall of the structure. The forms include panels which are fastened together with "ties" that extend from one panel to another panel. The ties restrict the panels from separation which would otherwise occur due to pressure caused by pouring of the concrete. After the concrete hardens, the ties are removed or extracted from the forms in order to remove or disassemble the forms. Removal of the ties results in a through-hole in the wall. The resulting through-holes are filled or patched in order to provide a smooth finished surface (and soundproofing and/or fireproofing) of the bay. The present inventors, however, have recognized that utilizing such a pre-existing through-hole would provide great benefit, enabling secure fastening of a guardrail stanchion or guardrail system and overcoming the problems with previous systems.

In accordance with the invention, then, the problem of securing a guardrail stanchion adjacent the edge of a deck under construction without damaging the deck or walls of the bay is solved by utilizing at least one through-hole of a concrete wall to affix a guardrail stanchion to the concrete wall. In this way, a stanchion may be securely affixed to the wall within the bay without reliance upon a compression-fitting, without obstructing the edge of the deck, and without damage to the deck. Such stanchion may also double as a life-line anchorage.

Particular optional embodiments of the invention may include insertion of a fastener through the through-hole. The fastener may optionally include a threaded pin and a corresponding nut. Also in particular embodiments, the system may include utilizing at least two through-holes, and the stanchion may include at least two openings each capable of receiving a fastener which extends through a corresponding through-hole. The stanchion may optionally be an elongated member having at least two elongated slots. The elongated member may be positioned generally vertically within the bay, and may receive fasteners through through-holes. The through-holes may be generally aligned in a vertical fashion on the wall. In a particular advantageous embodiment, a through-hole is a tie-hole. A through-hole may optionally be some other through-hole of the wall. Each of these details provides particular advantages and can be implemented independently of the others.

Particular embodiments of the invention may also include another stanchion affixed to an opposite wall, and a guardrail may be affixed to, and extend between, the two stanchions. The stanchion can receive any number of guardrails. Three guardrails are the most advantageous, however. In further optional aspects, a guardrail may include a cable affixed to a stanchion. Further particular embodiments of the invention include a stanchion which may optionally include a life-line ring or anchorage. Here again, each of these details can be implemented independently of the others.

The above summary of the present invention is not intended to describe each illustrated embodiment, aspect, or every implementation of the present invention. The figures and detailed description that follow more particularly exemplify these and other embodiments and further aspects in accordance with the principles of the invention.

BRIEF DESCRIPTION OF THE DRAWINGS

FIG. 6 is a partial view of a stanchion embodying the principles of the present invention.

Figure 1:
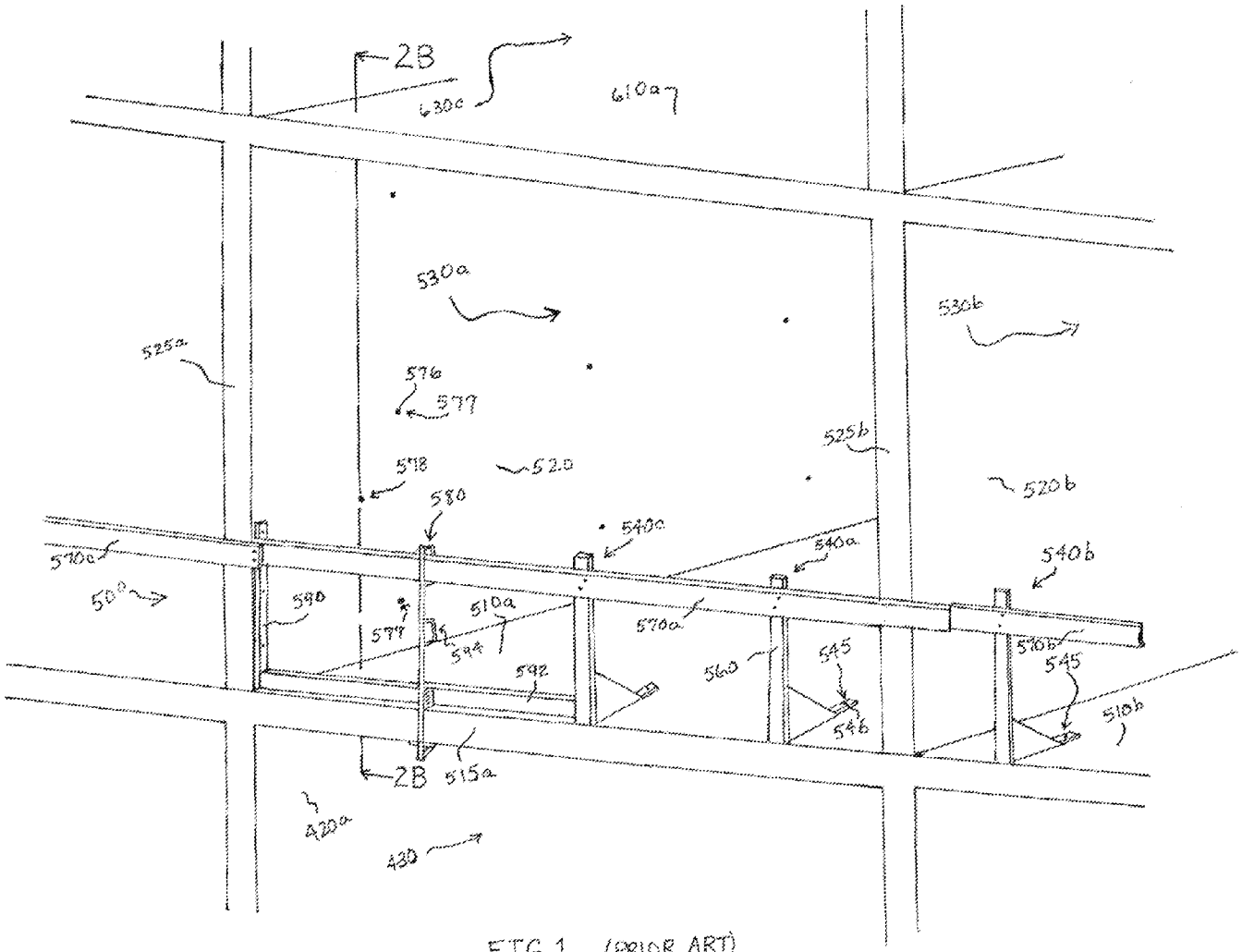
FIG. 1 (PRIOR ART)
FIG. 1 depicts a guardrail system known in the prior art.

While the invention is amenable to various modifications and alternative forms, specifics thereof have been shown by way of example in the drawings and will be described in detail. It should be understood, however, that the intention is not necessarily to limit the invention of the particular embodiments described. On the contrary, the intention is to cover all modifications, equivalents, and alternatives falling within the spirit and scope of the invention and as defined by the appended claims.

DETAILED DESCRIPTION

Among the guardrail systems known in the prior art are those referenced in the background section, above, as well as the example as shown in FIG. 1. FIG. 1 shows a prior art example of a guardrail system positioned upon a multi-story building. Supports 540*a*, 540*b*, 540*c* are secured to the floor or slab 510 (for instance, at slab 510*a*, 510*b* or the like) of a concrete structure 500 under construction. Structure 500 typically includes concrete slabs or floors 510 and concrete walls 520 (for instance, walls 520*a*, 520*b*, or the like) which are reinforced with steel cables, re-bar, mesh (combinations thereof) or other reinforcements. Structure 500 may accommodate a high-rise apartment or office building or other structure. A number of bays 530, such as bay 530*a*, 530*b*, 530*c* or the like are created which comprise various rooms of the building under construction. For instance, bays 530 may be the beginnings of the rooms to be constructed on the fifth floor (or alternatively some other floor) of the structure (with bays 430 and 630 (for instance, bay 630*c* or the like) comprising the beginnings of the fourth and sixth floors, respectively). Several or multiple floors or stories of bays 530 may be constructed in a single project or structure 500. Each bay 530 typically requires placement of a safety railing or fall protection system of some sort.

As shown in FIG. 1, supports 540 are constructed of wooden or metal material and secured to slab 510 by use of a bolt, screw, nail 545 or other male connector. Typically a powered hammer or drill, sometimes referred to a hammer drill (or perhaps in some cases a cartridge fired nail gun) is used to force the nail 545 (or multiple nails 545) through a leg 545 (such as a wooden leg, for example) of support 540 and into slab 510. In some cases a hammer drill is used to drill through the leg 545 and into the slab, and a tie wire or other material is inserted into the resulting hole which thereafter receives a nail, such as a size 16-duplex nail. The tie wire, which is somewhat malleable or flexible as compared to the duplex nail, deforms or spreads in order to secure a snug fit of the nail within the hole. In many instances, such as those due to expansion of the concrete, the nail is stuck into position and can't be extracted easily, thus requiring special effort, cutting of the nail, or added damage to the slab. Pounding of nails into slab 510 typically requires subsequent repair or patching of the concrete deck resulting in increased expense, labor costs, project delay, and debris. Moreover, nailing or drilling into the slab poses a hazard of damage to items that may be embedded within the slab, such as conduit or other materials or utilities. In an extreme case, hammer drilling into the slab 510 may result in the bit striking a cable or other item embedded within slab 510. The striking of an embedded cable is particularly dangerous since suspension or reinforcement cables are commonly under pressure at about 33,500 psi.

A series of supports 540 are typically configured within a single bay 530. Applicants have seen different types of supports and mechanisms included in conjunction with supports 540, such as supports 580 of the "slab grabber" variety (some of which are referenced above in the background section), or one of many other supports. Workers at a construction site may mix and match varieties of supports or systems to fashion the temporary barrier. In some cases, the barrier is handmade from available materials at the location, or includes devices such as slab grabbers or other mechanisms to supplement a cobbled-together solution. Such a cobbled-together "system" varies from project to project, even from bay to bay, and in practice, there rarely uniformity of such custom built systems. After the supports 540, 580 are positioned, rails 570 are connected between supports 540, typically by nailing rails 570 to a face 560 of support 540. Rails 570 might also extend from supports 540 located in adjacent bays, i.e., extend from bay 530*a* to bay 530*b*. Rail 570 extends across bay 530*a* to bay 530*b* by overlaying wall edge 525B. Rail 570*a* abuts rail 570*b* at bay 530*b*. In a case were a slab grabber 580 is used, the opposite end of rail 570*a* abuts wall 520, and rail 570*c* is nailed to rail 570*a*. Use of slab grabber 580 typically requires rail 570*a* to be slightly inset from the edge wall 525. In some cases, a two-by-four or other material or stud 590 will be nailed or secured to the inside of wall 520*a* so that rail 570*a* can be secured to the structure 500. Here again, nailing stud 590 into wall 520*a* results in damage to the wall, potentially requiring patching and the hazards and expenses mentioned above. Even in cases where all supports 540 are of a similar variety (i.e., in cases where only supports 540 are used, or where only supports 580 are used, or where only supports of some other variety are used), variations in the arrangement of the fall protection mechanism are common, such that workers are rarely able to maintain uniformity from bay-to-bay. In essence, each bay receives a custom-built guardrail system.

The guardrail system of FIG. 1 is but one example of a system used on a multi-story structure, and applicants have seen numerous alternative arrangements. The system of FIG. 1 would generally be considered deficient under OSHA or other standards. Among other potential deficiencies, support 540 would preferably face inward in order to better resist an outward force, and the nails used to secure rail 570*a* to support 540 would also preferably be nailed from the inside of the bay to also better resist outward forces that may act upon rail 570*a*. Typically, a guardrail system must include a toe board, a mid-rail, and a top rail. The toe board typically rests upon the slab 510, and the mid-rail and top rail are typically required to be spaced apart at certain set distances. The toe board 592 should run the length of bay 530*a*. If a toe board (not shown) were nailed to supports 540*a*, 540*c*, the toe board would extend outward from bay 530, potentially resulting in a gap (not shown) through which debris could fall. A mid-rail (not shown) would typically be positioned at about 21 inches from slab 510, and in FIG. 1, would run through loop 594 of slab grabber 580 (and or be nailed to face 560). Top rail 570 typically is positioned at 42 inches from slab 510. In such cases the worker must make accurate measure of the position in order to satisfy the safety requirements. The worker must also accurately measure the lengths of railings in order to fit within the respective bays or to align with a railing of an adjacent bay. In some cases, workers might become confused as to whether the top, middle or bottom of the top rail 570 (or mid rail as the case may be) is to be positioned at the designated height. Thus such custom made systems are troublesome in construction and in assurance of compliance with safety requirements.

Supports 540 as shown in FIG. 1 are set improperly. Since a primary purpose of the guardrail is to prevent people or objects from falling out from bay 530, as stated above, support 540 would preferably be turned around to better absorb an outward force. The wooden leg 550 operates as a base. Were support turned around with face 560 facing internally to bay 530, the base of support 540 would assist in better absorbing the force and reducing the likelihood of support 540 tipping outward. Moreover, railing 570 is nailed to the outside of support 540 at face 560. As such, a force applied to railing 570 would tend to cause the nails to pry away from face 560 and outward from bay 530. Applicants recognize that workers installing the custom system often take steps to simplify the assembly process, and may or may not appreciate the potential hazards in taking shortcuts. While placing supports 540 at the edge of slab 510 might allow a railing 570 to overlap into an adjacent bay (thus eliminating the steps of measuring or cutting the railing to fit within the bay), such a shortcut poses potential safety problems (including risks of safety violations and expensive fines). Positioning of the system at the edge also requires subsequent removal of the system in order to conduct finishing work at the edge (such as laying brick or other facade or wall/window structure at the edge.

A guardrail system is a temporary barrier that typically must also be periodically moved in order to supply materials to the bay (in addition to the requirement of being moved to conduct edge finishing). In a typical construction, a guardrail system must be at least temporarily removed in order to allow a forklift or crane carrying construction materials to be "flown" into the bay. The forklift or crane is use to supply pallets of materials used for further construction of the site. Thereafter, the guardrail needs to be re-assembled for safety purposes. In cases where the supports 540 are nailed into position, the process of removal and reassembly can be significant. Such action increases the labor costs and increases damage and debris due to repeated nailing or securing of the supports 540 to the slab 510. Further, and depending on how the system has been cobbled together, opening one bay 530*a* for receipt of materials might impact the guardrail mechanisms of other bays. Since materials need to be regularly supplied to the respective bays, the dealing with guardrails and attending to the recurring difficulties has been considered a typical burden or requirement of the job.

Other systems run rope or cables from one wall of a bay to the other wall. In some cases, a rope or cable will pass through walls in order to accommodate use for multiple bays. Maintaining sufficient tension of the cable in order to reduce or eliminate unacceptable sag is often a problem with such cable systems. Further, shut-down or take-down of the cable at one of the bays typically results in take-down of the cable from adjacent bays. Thus, loading a bay with construction materials may typically result in a hazard at adjacent bays which are at least temporarily not in compliance with safety standards or best practices.

The system of FIG. 1, and other custom systems or other types of systems including those mentioned above or mentioned in the background section, neither teach nor suggest, nor are adapted to provide the simplicity and usefulness of the stanchion and systems of the present invention.

Many of the known guardrail or stanchion systems, including the example of FIG. 1, either cause damage to the concrete wall or slab, or if they use a clamping or compression-fit to avoid such damage, either interfere with the edge of the slab or are susceptible to slippage or suffer from other deficiencies of a compression or friction-fit arrangement. As noted above, it remained for the present inventors to recognize that avoiding the above deficiencies would provide numerous benefits, as detailed herein. Further, it remained for the present inventors to develop a solution for securely mounting a guardrail stanchion and system that avoids damage to the wall or slab, that avoids covering the edge of the flooring, and that does not rely upon a compression-fit system. The inventors developed a guardrail system that utilizes aspects of a system heretofore unrelated to guardrails. The heretofore unrelated system involves concrete wall forming techniques, discussed below with reference to FIG. 2.

Heretofore unrelated to the use or set-up of a "standard railing" or guardrail system is the formation of the walls of a structure. FIG. 2A depicts one simplistic example of a wall form 552 used for forming a wall of a structure. Particularly. FIG. 2A is a partial side view of form 552 used in conjunction with a forming system 550. Forming system 550 may be used for pouring and shaping of a wall and ceiling/deck structure (such as, for example, the wall 520*a* and a ceiling/deck 610 of FIG. 1). Form 552 is placed atop slab 510 generally as shown, and typically in alignment with wall 420 immediately below. Form 552 includes opposing form panels 553*a*, 553*b* spaced apart a desired distance in order to create a poured wall, such as wall 520 (See FIG. 1), of a desired thickness. The area A between panels 553*a*, 553*b* will be occupied by the poured concrete (or other similar substance) resulting in wall 520. Form system 550 also includes ceiling/deck side panels 554 (shown in cut-away view), together with ceiling/deck panels (not shown) which form in place a slab such as slab 610*a* (See FIG. 1) when concrete is poured thereon. Rebar, mesh or other items (including but not limited to conduit used for electrical, plumbing or other purposes, or a cone or sleeve), may be inserted within space A to provide desired structural properties or functions.

Panels 553 are typically substantially rigid panels typically made of steel and having a generally rectilinear shape of a desired wall dimension. Panels 553 may also be made of other materials such as wood or plastic or metal or composites of alternative materials. Various panel systems 550 are available for pouring such structures. In one such system manufactured by Outinord, a model TMPH 80 is a basic panel having a dimension of about 2500 mm in width and 2345 mm in height. The TMPH 80 basic panel has a corrugated type of structure on one side with a smooth surface on an opposite side (the smooth surface side is the side where the concrete is poured). Whalers (not shown) or other re-enforcement members typically run horizontally along the corrugated side of the panel 553. Holes are provided within the whalers or re-enforced areas for receiving ties (ties described below). A panel 553 typically includes at least 4 holes for receiving ties. With the TMPH Model 80, two holes are typically positioned within whalers at about 16 inches from the bottom edge of panel 553, each inset approximately 625 mm from either end, leaving a span of approximately 1250 mm between the two holes. Another two holes are positioned within a whaler approximately 5 feet 8 inches from the bottom edge of panel 553 and have a similar spacing as compared to the lower two holes.

Once a pair of panels 553*a*, 553*b*, are positioned in opposing relationship as generally shown in FIG. 2, a wall stop or bulkhead 555 (shown in partial or cut-away view) covers the end of the space A to contain the poured concrete. Panels 553 are held apart in spaced relation to each other by spacers 556 or other spacer means. Ties 575 are positioned between panels 553 and are used to hold panels 553 together in spaced relation so that panels 553 to not spread apart due to the force of the poured concrete. A series of ties 575 are typically used on any given arrangement of a wall form 552. Applicants alone have recognized that tie holes are conveniently positioned, and at least one series of tie holes are positioned relatively close to an edge 525 of the bay structure 500.

In operation of the heretofore unrelated wall-forming techniques, concrete or other similar substance is poured into and onto form system 550. Concrete fills the spaces A and areas atop the deck panel to create a formed wall and corresponding ceiling/slab structure when the concrete or other substance hardens. The ceiling of one bay functions as the floor of an upper bay. Once the concrete has hardened, and usually the following day, the form system 550 is removed. The system 550 is then reset at another location on the project to form additional walls, ceilings/slabs and bays. Removal of wall form 552 includes removal of ties 575. The removal of a tie 575 results in a tie-hole 576 (see FIG. 1, for instance) which runs through resulting wall 520. With the Outinord TMPH 80, 2500 mm panel, tie-hole 576 as shown in FIG. 1 is positioned at approximately 5 feet 11 inches upwards from slab 510*a*, A number of tie-holes 576 appear throughout the resulting wall, and depending on the form system 550 that is used, the holes 576 are arranged in a particular pattern, or at least in the pattern showing where the respective ties 575 were positioned for the particular pouring operation. The resulting tie-holes 576 are then filled or patched. Advantageously, applicants have recognized that a resulting tie-hole 576 may be positioned adjacent or relatively close to an edge area of structure 500, such as with the Outinord TMPH 80, a tie-hole 576 may be positioned about 625 mm from edge 525.

Figure 2B:
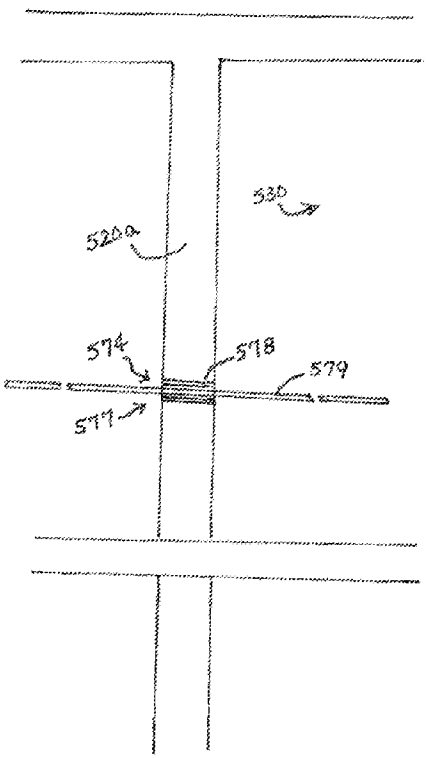
FIG. 2B (PRIOR ART)
FIG. 2B depicts a poured concrete wall structure having a sleeve as known in the prior art.
Figure 2A:
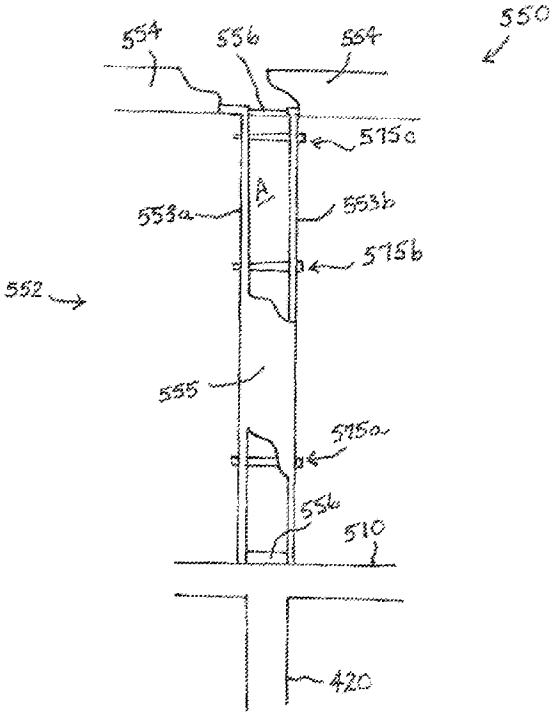
FIG 2A (PRIOR ART)
FIG. 2A depicts a wall forming system known in the prior art.

In some instances, as shown in FIG. 2B, a sleeve 578 such as a PVC pipe, may be inserted into wall form 552 in order to form a desired through hole 577, or in that particular case, a sleeve hole 574. A sleeve hole 574 may be used, for instance, for insertion of a rope or safety cable 579 which may span across multiple bays 530. Sleeve 578 may be positioned at a height appropriate for a "standard railing." In a typical case, cable 579 is secured to a wall 520 of structure 500, such as with an eye bolt anchored into a wall 520. Cable 579 then spans across bays 530 by threading through a series of sleeves 578. A tightening mechanism, such as a mechanism commonly referred to as a "come-along" is used to tighten the safety cable 579. Cables may also be tightened with a turnbuckle or other devices.

A sleeve 578 may also be placed at different positions to assist with the construction effort, such as positioning at various locations to accommodate "outrigging" which is positioned on the outside of structure 500. Outrigging is used in order to construct the end walls (not shown) of a structure 500. Outrigging may include a platform which hangs off the end of the structure and allows workers to position themselves to set forms. The outrigging may also support the additional forms to be placed for the pour of the subsequent level. While not shown, a tie may be inserted through a sleeve in order to secure a "bucket" to the exterior of the structure. The bucket is positioned to hold a console pignion or "outrigging" end wall platform at the exterior wall of the structure. In some cases, a tie-hole 576 of an exterior wall may also be used to assist in stabilizing the outrigging.

There are a variety of different ties 575, some of which include ties of the taper-tie variety, or flat-tie variety. A taper tie is tapered to allow for easier removal of the tie when the concrete hardens. A tie 575 usually includes threads at one end, and some ties are threaded at both ends. Usually a tie receives a nut (such as a wing-nut or other nut) to tightly secure the panels 553 into position. Ties 575 come in various lengths, any of which may be used depending on the desired thickness of the resulting wall to be poured. The ties 575 and panels 553 are configured such that when a nut is fully tightened upon a tie, the panels 553 are precisely spaced. With such systems, and as long as the ties are fully tightened, there is no need to measure the distance between panels. A typical tie 575 has a diameter of approximately 1⅙ inches (although other dimensions may be used). Such wall forming systems have been used for years.

The known guardrail mechanisms have several shortcomings as referenced above, including those resulting from nailing into the concrete structure, or covering the edge of the deck in the case of a slab-grabber mechanism. As noted above, it remained for the present inventors to recognize that mounting the guardrail device and related stanchion items adjacent the edge of the deck or other opening of the structure by using means other than a compression-fit that covers the edge, and not having to accommodate for nailing or bolting of the stanchions into the concrete wall or deck, while utilizing a pre-existing feature of the structure that requires little or no extra preparation, planning or expense, would provide numerous benefits as describe herein. It remained for the present inventors to develop a guardrail system that utilizes an aspect of the heretofore unrelated system of wall formation, namely, utilizing a through-hole produced from the concrete wall forming techniques. The through-hole contained in the wall of a bay of the structure is used to affix a guardrail stanchion. Utilizing a through-hole allows securing of a guardrail stanchion without harm to the flooring or wall, without covering the edge of the flooring, and without relying upon a compression-fit to secure the stanchion in place. Among the many benefits of the present invention includes the ability to affix a life-line to the stanchion. The present system provides superior support as compared to relying upon a compression-fit or other past systems.

Figure 3:
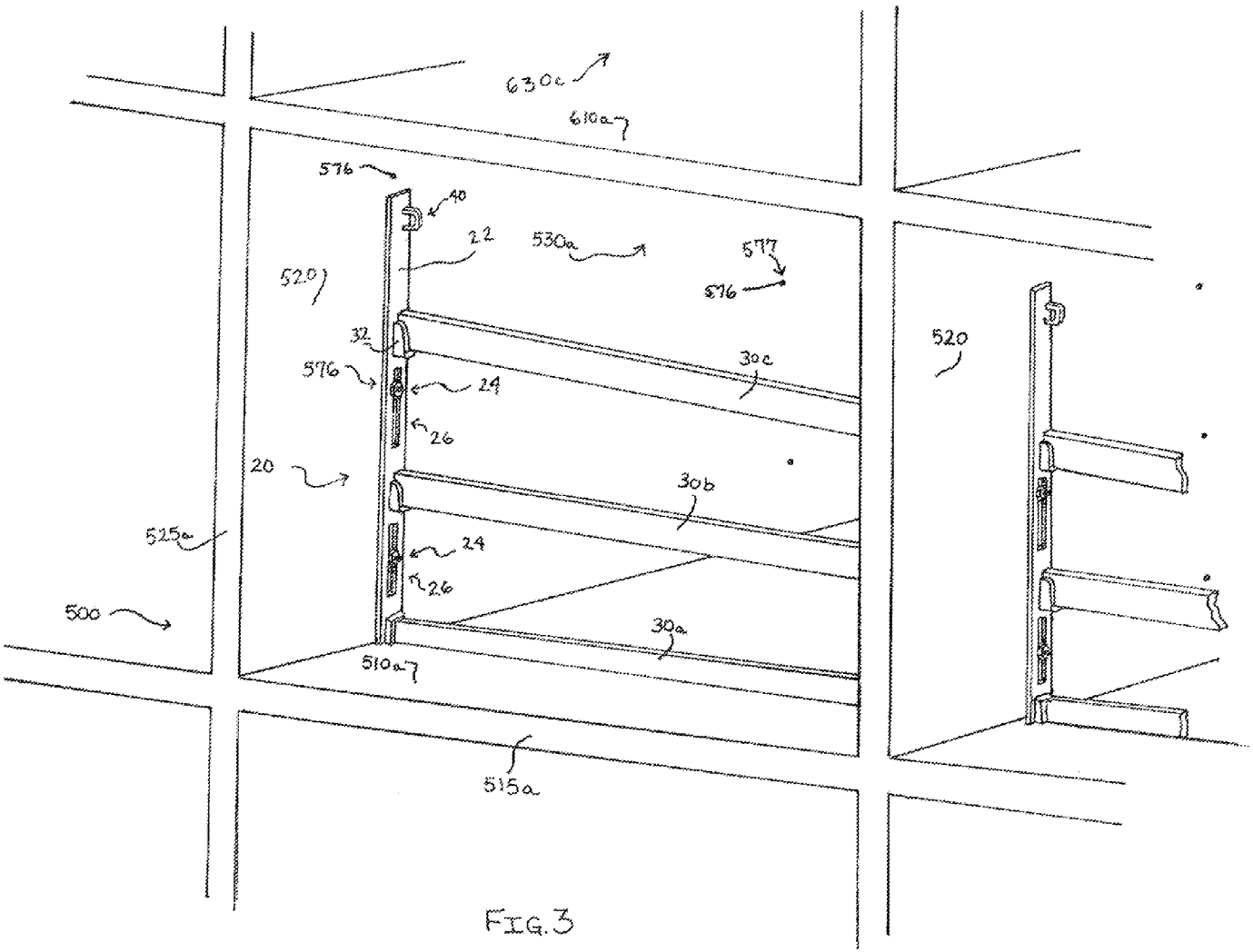
FIG. 3 is a perspective view depicting a guardrail and system embodying the principles of the present invention.

Referring now to FIGS. 3-20, a guardrail system embodying the principles of the present invention is generally depicted with reference to numeral 20. In one aspect, stanchion 22 of system 20 is an elongated member and is affixed to concrete wall 520*a*. As used herein in conjunction with the claimed invention, a "concrete wall" of a structure includes a wall that is made with concrete, or made with a substance that is similar to construction concrete, such as a substance which hardens after pouring. Stanchion 22 is positioned within the bay 530*a* of structure 500. For illustrative purposes, stanchion 22 (and system 20) shown in FIG. 3 is depicted in an enlarged scale within bay 530*a*. A "bay" is generally that region defined by a floor and two opposing structures such as walls or the like, and in the illustration of FIG. 4, bay 530*a* is defined by floor 510*a* and walls 520*a* and 520*b*. A bay may also include a ceiling, and in the illustration of FIG. 3, bay 530*a* may optionally include ceiling 610*a*. A bay may or may not include a back wall. A bay may also include a floor and opposing structures such as columns positioned adjacent an elevator shaft or other opening in a floor. A structure 500 typically comprises multiple bays such as bays 430, 530, 630 in any desired grid structure.

In accordance with the invention, stanchion 22 is affixed to wall 520*a* within bay 530*a* by utilizing a through-hole 577. The present inventors have discovered that utilizing a through-hole 577 allows for stanchion 22 to be securely affixed to wall 520*a* in a manner and to a degree that is far superior compared to prior systems. Utilizing through-hole 577 allows stanchion 22 to be affixed without harm to slab 510*a* or wail 520*a*, and avoids coverage of or placement about deck edge 515*a*. Further, utilizing through-hole 577 allows for a positive connection to wall 520*a* without having to rely upon a compression or friction-fit. Changes to the wall 520*a*, such as through natural expansion or compression of concrete, for instance, will not affect the secure affixing of stanchion 22 to wall 520. Likewise, changes to stanchion 22, such as through natural expansion or contraction of the material comprising the stanchion will not affect the secure affixing of stanchion 22 to wall 520. Utilizing a through-hole 577 achieves a significant reduction in effort to assemble and/or remove guardrail system 20 and eliminates the need to repair damage to the slab 510*a* or wall 520*a*. Utilizing a through-hole 577 also reduces a safety hazard otherwise present with compression or friction-fit systems since natural changes in the structure or materials will not cause stanchion 22 (or system 20) to loosen, dislodge, slip or fall from bay 530*a*.

In accordance with an advantageous feature of the invention, through-hole 577 is a tie-hole 576 which results from the process of forming wall 520*a* as generally described above with reference to FIG. 2A. As such, tie-hole 576 is a pre-existing hole, and therefore, no special effort is required in preparation for set-up of guardrail system 20. Particularly, use of a tie-hole 576 avoids having to drill a hole into or through van 520*a*. Reducing damage to the walls is also important, among other reasons, for maintaining the aesthetics of the raw wall which is desired in modern design. Avoiding drilling also saves on the labor and expense, and eliminates risk of damaging items that might lie within the wall, including embedded cables or other items.

A system embodying the principles of the invention can utilize any desired number of through-holes 577. In accordance with an advantageous feature of the invention, system 20 utilizes two through-holes 577. The inventors have discovered stanchion 22 can be affixed using two, or at least two, through-holes 577 without giving rise to a spinning action of stanchion 22 if only one through-hole 577 were otherwise utilized to affix stanchion 22. Utilizing a through-hole 577 at both a lower portion of wall 520 and at an upper or mid portion of wall 520 allows for stanchion 22 to be secured in a generally vertical fashion so that it may support rails 30 as described further below. Use of two through-holes 577 allows for stanchion 22 to be affixed at both a top portion and a bottom portion of stanchion 22, thus resulting in a more secure hold against wall 520*a*. Use of three through-holes 577 may add additional securing action, however in practice it may be difficult to align three through-holes 577 which would add to the effort of set-up or take-down. Use of two through-holes 577 to affix stanchion 22 to wall 20*a* is regarded by the present inventors as a preferred embodiment.

In accordance with an advantageous feature of the invention, through-hole 577 is a tie-hole 576. Other through-holes 577, such as a sleeve hole 574, or cone holes or other holes running through wall 520, may also (or alternatively) be used. In accordance with an advantageous feature of the invention, utilizing a through-hole 577 to affix stanchion 22 includes use of a fastener means, which fastener means includes but is not limited to a fastener 24 inserted through the through-hole 577. Fastener 24 may be of any desired variety. In accordance with an advantageous feature, fastener 24 is a threaded pin 24*a*, such as, for instance, a coil rod that may extend through through-hole 577. Fastener 24 may be made of metal (preferably steel) or other desired material, and may include features similar to coil rods or ties used for setting the panels 553 of forming systems 550.

Figure 4:
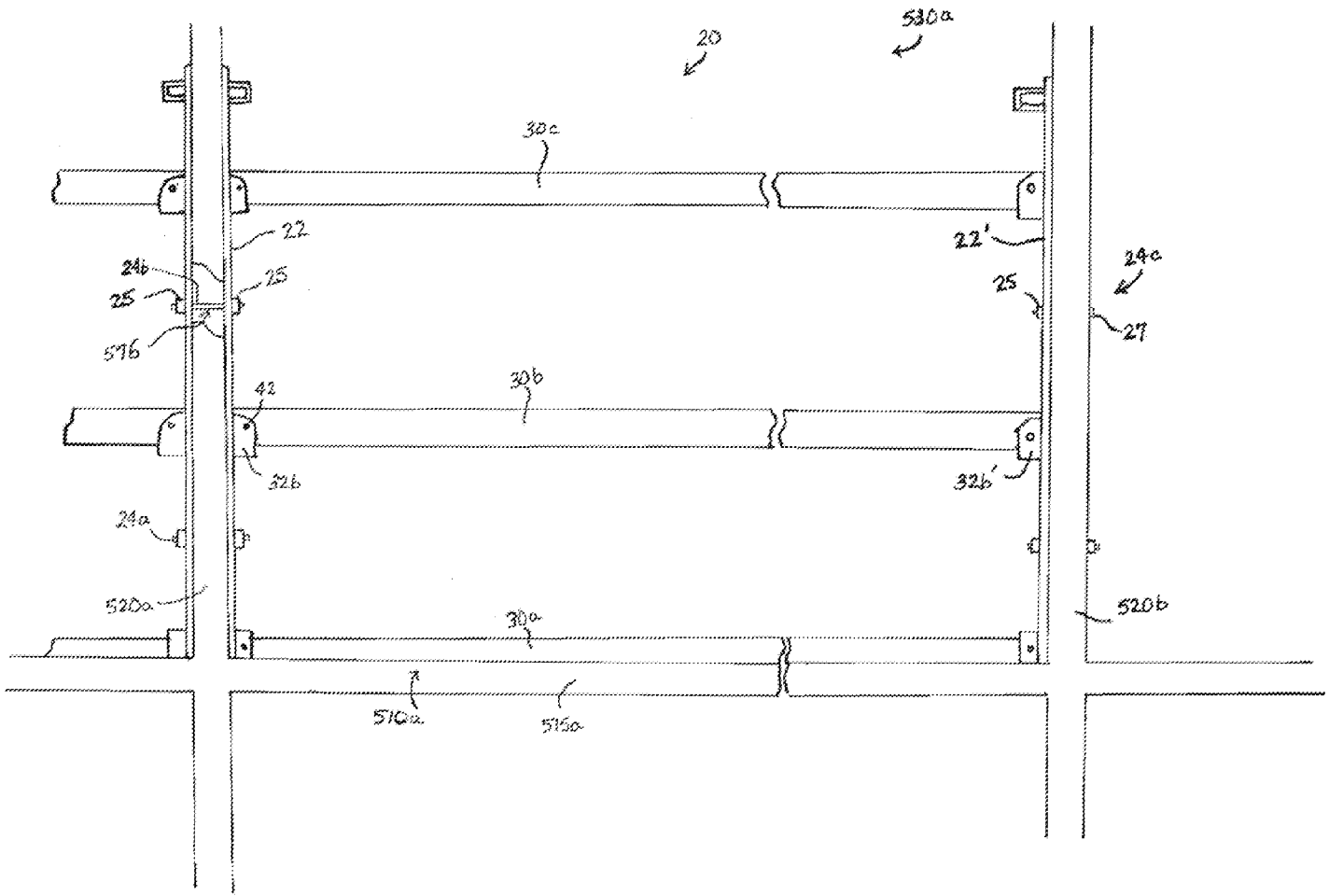
FIG. 4 is an elevation view depicting a guardrail and system embodying the principles of the present invention.

As shown in FIG. 4, and with reference to the cut-away portion of that view, fastener 24*b* is positioned within tie-hole 576 and runs from one side of wail 520*a* to the other side of wall 520*a*. In this aspect, fastener 24 advantageously extends through stanchion 22. A nut 25 or other securing mechanism may be used in conjunction with fastener 24 to tighten stanchion 22 against wall 520*a*. Nut 25 screws upon threads of a coil rod variety of fastener 24*b*. Fastener 24*b* may include threads on either end which protrude from either side of wall 520*a* so that a nut 25 can be secured to each side and tightened. Preferably the threads are positioned on fastener 24*b* such that a full tightening of nut 25 assures appropriate securing of stanchion 22. Fastener 24 may also be a pin or bolt 24*c* or threaded bolt having a head 27. An optional washer may be used in conjunction with fasteners 24. An example of one fastener 24*b* that may be used in conjunction with a stanchion 22 includes a coil rod such as those manufactured by Outinord or other manufacturer.

Figure 5:
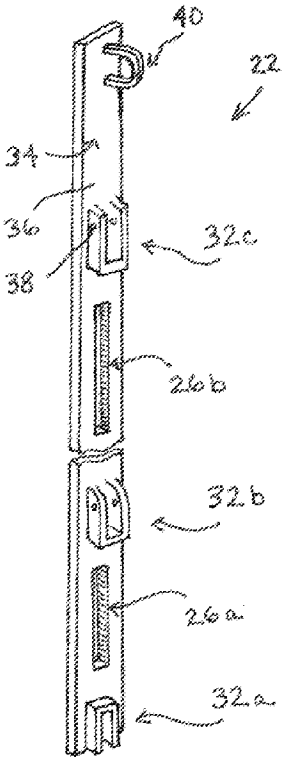
FIG. 5 depicts a stanchion embodying the principles of the present invention.
Figure 11:
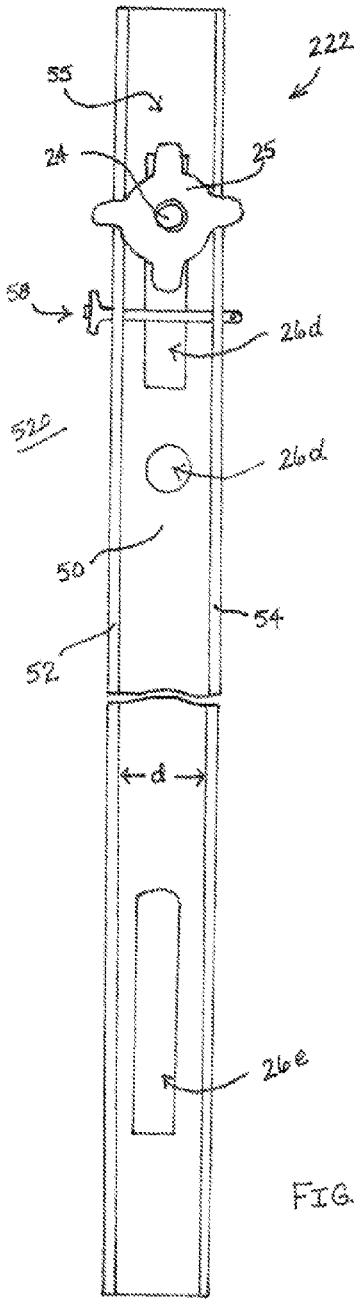
FIG. 11 is an elevation view depicting a stanchion embodying the principles of the present invention.

In accordance with an advantageous feature of the invention, stanchion 20 is an elongated member and includes at least two openings or slots 26 (See for instance, FIG. 5, FIG. 11). While a single slot 26 may be sufficient, use of two slots is advantageous since it better allows for stanchion 22 to be affixed utilizing two through-holes 577. Advantageously, slots 26 are elongated in order to accommodate efficient alignment with through-holes 577. Different wall forming systems may result in ties 575 being positioned in differing locations or spacings, therefore the resulting through-holes 577 (particularly the resulting tie-holes 576) may be positioned within the walls at various locations. Stanchion 22 having elongated slots 26 makes for easier alignment with the fasteners 24, which are positioned within respective tie-holes 576, for instance. Stanchion 22 may include additional slots 26 as desired. Slots 26 may be positioned at various locations upon stanchion 22 and are not meant to be limited to the arrangement shown. Further, while stanchion 22 is preferably an elongated member, various sizes, dimensions and configurations may be used as desired. Stanchion 22 can be made from any desired material. Stanchion 22 of the illustrative embodiment is made of metal, preferably steel.

Figure 18:
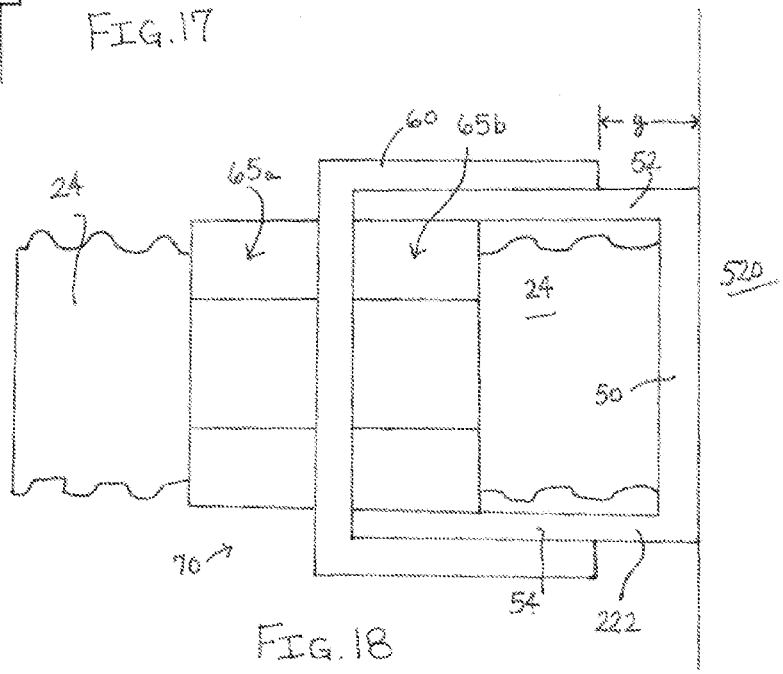
FIG. 18 is a top view of a stanchion and cap for use with a system embodying the principles of the present invention.

Stanchion 22 is adapted to receive a guardrail, such as a guardrail 30 or safety line or cable 579 (see FIG. 18 for cable 579). As shown in FIG. 5, one aspect of stanchion 22 includes a guardrail support 32 connected to a base 34. Support 32 is connected to base 34 at a front surface 36. Support 32 may be integrally connected as desired. In one aspect, support 32 may include a cradle-like mechanism to receive a guardrail 30. Openings 38 in support 32 allow for a fastener, such as a nail or pin or other fastener to be inserted to secure guardrail 30. Multiple openings 38 may be used to accommodate a variety of fastening arrangements. Multiple supports 32 may also be configured to accommodate use of multiple guardrails 30. Supports 32*a*, 32*b*, and 32*c* are positioned on stanchion 22 in order to provide guardrail positioning at desired heights. Further, slots 26 may be positioned at various locations above or below respective supports 32. While slot 26*b* is positioned between support 32*b* and 32*c*, slot 26*b* may also be positioned above support 32*e*, or at some other location upon stanchion 22. Positioning slot 26*b* above support 32*c* accommodates for a more secure connection of stanchion 22 to wall 520, and may also provide further strengthening of stanchion 22 in situations where life-ring 40 is used. While support 32*a* is shown in a generally upside-down "U" configuration, it may also be configured similar to the other supports 32*b*, 32*c*, or may include an opening at a top and bottom portion so a toe-board 30*a* may be slid or inserted into support 32*a*. Preferably support 32*a* has an open bottom as shown so that toe-board 30*a* sits flush upon slab 510*a*.

As shown in FIG. 5, life-ring 40 extends from base 34 of stanchion 22. Life-ring 40 may be welded into position and is preferably made of steel or other strong material designed to support the weight of a worker and to comply with personal fall arrest standards. Life-ring 40 is an anchorage used for attachment of personal fall arrest equipment and is independent of any anchorage being used to support or suspend platforms. Under some regulations, for instance OSHA regulation 29 CFR 1926.502(d)(15), life-ring 40 must be capable of supporting at least 5,000 pounds (22.2 kN) per person attached; or shall be designed, installed, and used as part of a complete personal fall arrest system which maintains a safety factor of at least two and which is under the supervision of a qualified person. Life ring 40 may be configured to comply with other regulations or standards. A life-line anchorage in compliance with OSHA standards includes a stanchion having an anchorage that once affixed to a wall satisfies the minimum OSHA requirements for life-line support.

With further reference to FIG. 4, one aspect of system 20 includes use of stanchion 22 affixed to wall 520*a*. Tie-hole 576 is used to affix stanchion 22 to wall 520*a*. Fastener 24*b* runs through tie-hole 576 and is secured on either end by a nut 25. Alternative fastener means may be used together with tie-hole 576 to affix stanchion 22 to wall 520*a*. Positioned opposite stanchion 22 is stanchion 22', which is also positioned within bay 530*a*. Stanchion 22' may optionally be affixed to wall 520*b* utilizing at least one through-hole 577, such as a tie-hole 576 or sleeve hole, of wall 520*b*. Guardrail 30*b* is connected to and extends from stanchion 22 to stanchion 22'. Guardrail 30*b* may be of a two inch by four inch wooden variety and nailed or secured to supports 32*b*, 32*b'*, or may be of any other variety as desired. A worker may conveniently assemble a guardrail onto the stanchion 22 generally as shown. A worker may also conveniently remove or replace a guardrail 30 by removing the fastener or nail 42 or pin (which may also include a push pin or cotter pin or clasp mechanism). Each of the guardrails 30*a*, 30*b*, 30*c* (or additional guardrails 30) may be removed in order to open the bay 530*a* to receive construction materials within the bay. Once the materials are placed within bay 530, the guardrails 30 may be quickly replaced in order to continue compliance with safety measures or requirements. Guardrail 30 may also be of a telescoping variety having a length sufficient to span between stanchions 22, 22'. Non-limiting examples of some guardrail devices 30 are shown with reference to FIG. 7 and FIG. 8. Guardrails 30 may also be made of metal or plastic or wood or a combination of these or other materials.

Figure 7:
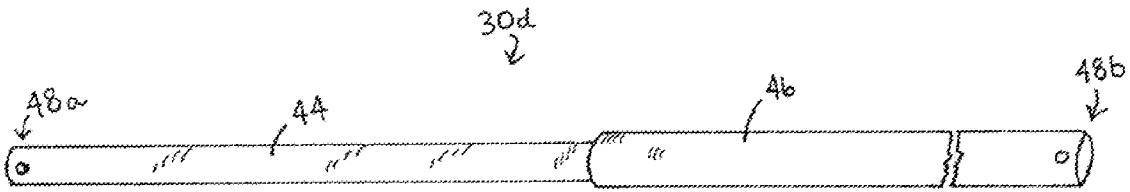
FIG. 7 depicts a guardrail for use with a stanchion embodying the principles of the present invention.
Figure 8:
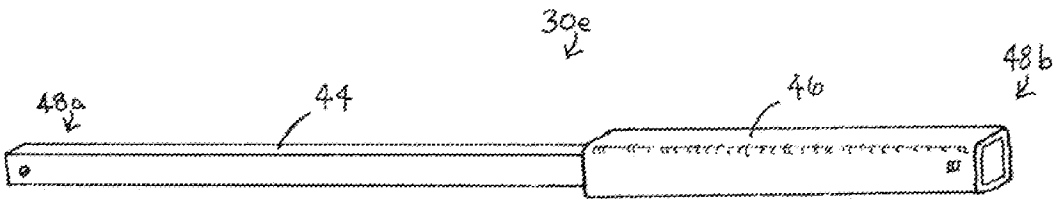
FIG. 8 depicts a guardrail for use with a stanchion embodying the principles of the present invention.
Figure 9:
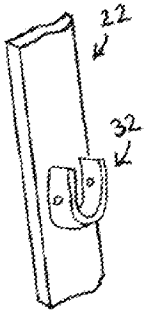

FIG. 7 depicts one variety of a rail 30*d* having a first segment 44 which is a rounded element inserted into a second segment 46. Segments 44, 46 may be of any length sufficient to span a desired width of a bay. Segment 44 telescopes within segment 46, and each have rail ends 48 which may connect to a stanchion 22, and preferably connect to opposing stanchions 22 within a bay. Rail end 48*a* may include a clasp or a receiving hole and may be configured to insert into a corresponding guardrail support 32 of stanchion 22 such as shown in FIG. 6. End 48*b* may also insert into a corresponding guardrail support. Second segment 46 may include a taper (not shown) to reduce the diameter of the rail 30*d* at the area of end 48*d* so that end 48*d* may also conveniently insert into a support 32. Alternative arrangements of ends 48 (or corresponding supports 32) may be constructed of a universal design so that rails 30 may be connected to a variety of supports 32 or a variety of stanchions 22. The support 32 as shown in FIG. 3 is a more rectangular variety whereas the support 32 shown in FIG. 6 is more of a rounded variety. Support 32 may be of different varieties as desired. FIG. 8 depicts another non-limiting variety of a rail 30*e* having a first segment 44 which is a tubular element, in this case a generally rectangular or square-tube, inserted into a second segment 46. A corresponding guardrail support may be configured to receive an end 48*a*, 48*b* to secure rail 30*a* within a bay. Rails 30 may be used as a top rail, mid rail, or a toe rail as desired. Rails 30 of the telescoping variety simplify assembly of system 20 since workers are not required to measure or cut lumber to fit the proper span of the bay. Rails 30 may be made of different materials, including but not limited to wood, plastic, metal or combinations or composites of the same.

With further reference to FIG. 3, system 20 is configured in a set-back position within bay 530*a*. For instance, stanchion 22 is set-back from edge 515*a* and 525*a*. Utilizing through hole 576 to affix stanchion 22 allows for a secure and set-back connection without damage to structure 500 and without covering edge 515*a*, 525*a*. This arrangement is advantageous since workers do not have to move system 20 in order to work on edge finishing. If for some reason system 20 required movement, a quick dismantling can occur by unfastening the guardrails 30 and fasteners 24. No nailing or repair to the structure is required.

Figure 9:
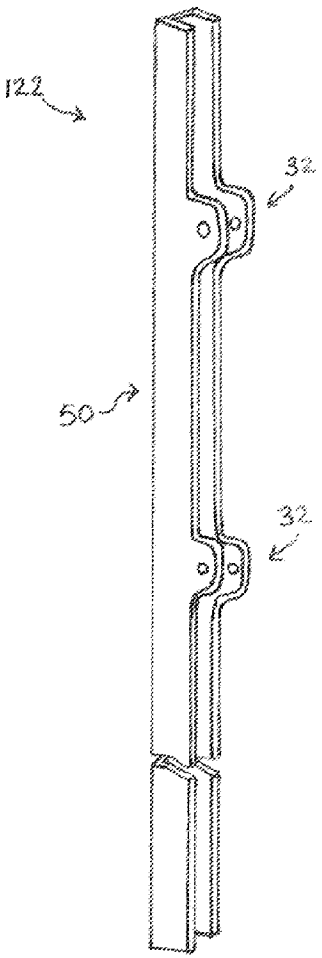
FIG. 9. is a perspective view depicting a stanchion embodying the principles of the present invention.

FIG. 9 shows a further embodiment of a stanchion 122. Stanchion 122 is an elongated member having a generally C-shaped cross section made of metal such as channel iron or the like. Stanchion 12 can also be made of other materials. Stanchion 122 includes guardrail supports 32 which receive guardrails 30. Supports 32 may be positioned at any desired height and preferably at locations to accommodate compliance with OSHA or of her standards or regulations. Stanchion 122 also includes an opening, and preferably an elongated slot or slots on a back segment 50. The backside portion 50 is designed to engage against the wall 520 for attachment thereto. A fastener 24 is inserted into a through-hole 577 and through the elongated slot to secure stanchion to wall.

Figure 10:
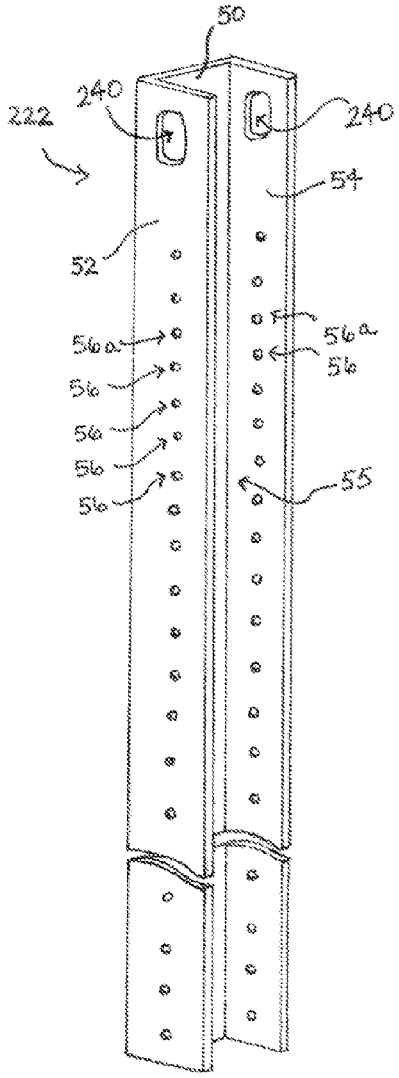
FIG. 10. is a perspective view depicting a stanchion embodying the principles of the present invention.

FIGS. 10 and 11 show a preferred embodiment of a stanchion 222. Stanchion 222 has a generally C-shaped cross section (C-channel). Side segments 52, 54 extend from a base or back segment 50 generally as shown, and preferably at right angles to back segment. Back segment 50 includes at least one opening 26. Opening 26 may include an opening of a circular variety 26*c* or may be an elongated slot, such as at 26*d*, 26*e*, or similar elongated opening. Opening 26 is designed to receive a fastener 24 therethrough. Stanchion 222 may include multiple openings 26 to accommodate insertion of fasteners 24 which may be inserted through through-holes 577 at various locations on wall 520, for instance. Side segments 52, 54 include adjustment ports 56 which generally run the length of segments 52, 54. Adjustment ports 56 on segment 52 are typically aligned opposite adjustment ports 56 on segment 54, such as ports 56*a*, 56*a*. A pin or other rail fastener 58 (See, for instance, FIG. 11) may be inserted into respective adjustment ports 56, such as through 56*a*, 56*a* in order to secure a handrail 30 to stanchion 222. Rail fastener 58 may be of the ball-pin variety which may be sized to tight tolerances within ports 56 and includes a push button to operate selective release or insertion of fastener 58. The ball-pin variety of fastener 58 accommodates a quick insert and release while also providing a securely holding fastener. Instead of a ball-pin, fastener 58 may also be a nail, cotter pin, pin, bolt, nut, or other fastener which inserts through a port 56 and into or through a guardrail 30. Fasteners 58 may be positioned within stanchion 222 at any of the variety of ports 56 so as to provide a worker with optional locations for placing the height of the guardrails 30. Multiple guardrails 30, or other devices or mechanism may be attached to stanchion 222 by utilizing ports 56.

An anchorage 240 as shown in FIG. 10 may be included in stanchion 222. Anchorage 240 operates similar to life-ring 40 described above. A worker may clip a life-line to anchorage 240 for safety. Anchorage 240 may be defined by side segment 52 and/or segment 54 of stanchion. Alternatively, rail fastener or pin 58 may also operate as a life-line anchorage. Optionally, a block or other element may be inserted within channel 55 and secured with rail fastener or pin 58 (or multiple pins 58). A user may clip onto such a block fastened to stanchion 222. Also optionally, an element may be welded within channel 55 as an anchorage, such as welding of a pin or other element between segments 52, 54.

FIG. 11 is an elevation view of stanchion 222 showing a nut 25 used to secure stanchion 222 to wall 520. A fastener 24 is inserted through a through-hole 577. Nut 25 is preferably a hammer nut having interior threads which receive fastener 24. Fastener 24 is preferably a coil rod having external threads. Nut 25 is placed over fastener 24 and hand-spun in order to tighten upon stanchion 222 for securing to wall 520. For a snug fitting to assure stanchion 222 does not move or slip away from wall 520, nut 25 may be struck and spun with a hammer or other object (nut 25 may also be turned with a wrench). Typically nut 25 is spun in a clockwise direction in order to tighten upon fastener 24. While pin 58 is shown to be inserted into stanchion 222 adjacent nut 25, pin 58 most likely is positioned away from nut 25 so as to secure a guardrail 30 to stanchion 222 without interference with nut 25. Further, since through holes 577 typically do not align at a desired height for positioning of a guardrail 30, pins 58 are likely to be positioned away from nut 25. Particularly, in the case of use of an Outinord form, TMPH Model 80, a through-hole 577 is typically located about 5 feet 10 7/16 inches above slab 510, so fastener 24 and nut 25 are also positioned at about 5 feet 10 7/16 inches above the slab, with at least one pin 58 positioned at about 42 inches above the slab 510 to secure a top rail (or cable) of the guardrail system 20. Ball pin 58 may also operate as a life-line anchorage for appropriate tie-offs. A more permanent element may also be connected, such as by welding, within channel 55 for use as a life-line anchorage. Life-line ports/opening or anchorage 240 may also be included with stanchion 222. A 2×4 may also be positioned within channel 25 and secured thereto by nailing so as to operate as a guardrail or other support. A winch or winder may also be positioned within or adjacent channel 25 to operate a cable or rope system, and also as described further below.

Figure 13:
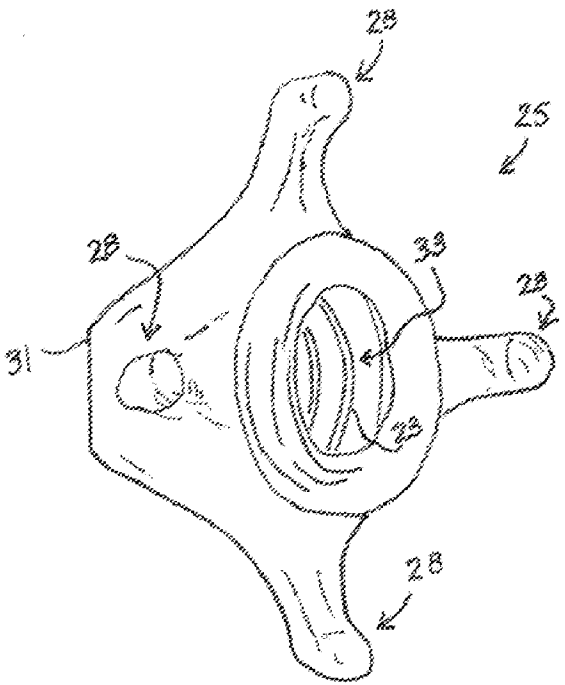
FIG. 13 is a perspective view of the nut of FIG. 12.
Figure 12:
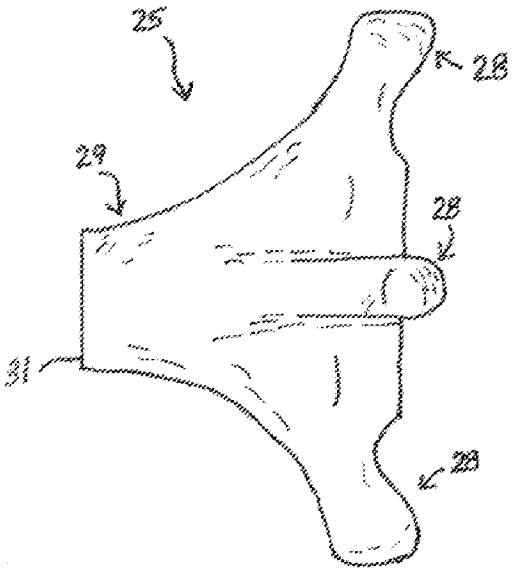
FIG. 12 depicts a nut for use with a system embodying the principles of the present invention.
Figure 14:
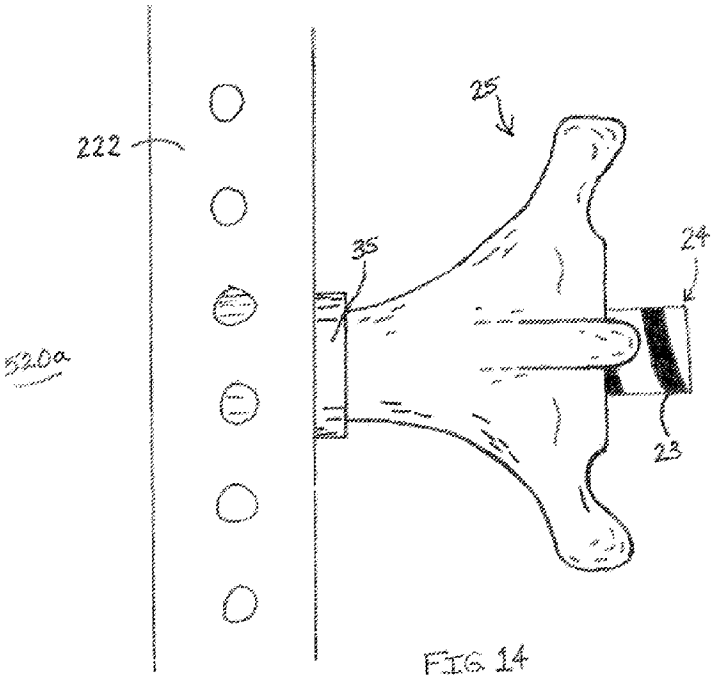
FIG. 14 is a partial view of a stanchion and fastener for use with a system embodying the principles of the present invention.

As shown in FIGS. 12 and 13, nut 25 is of a hammer-nut variety. Nut 25 includes wings 28 which may be struck by a hammer or other object. Nut 25 includes a neck area 29 which terminates at face 31. Face 31 abuts a surface, such as at back segment 50 in order to secure a tight engagement. A bore 33 runs longitudinally through nut 35 and terminates at face 31. Bore 33 includes threads which mesh with threads of a fastener 24. As shown in FIG. 14, nut 25 is used to secure stanchion 222 to wall 520*a*. Fastener 24 inserts into and extends through through-hole 577 in wall 520. As nut 25 is tightened by screwing upon threads 23, face 31 abuts against stanchion 222. In one aspect, nut 25 may have neck 29 which fits within channel 55 and may be tightened by turning about fastener 24. In some instances, however, nut 25 may be too large do fit within channel 55 due to interference with wings 28. Alternative nut arrangements having different wing configurations may be used as desired and to allow appropriate insertion within channel 55.

As shown in FIG. 14, an optional washer 35 is positioned within channel 55 of stanchion 222. Face 31 of nut 25 abuts washer 35 which in turn abuts against stanchion 222 at back segment 50. Tightening of nut 25 about threads 23 results in affixing stanchion 222 to wall 520. Striking nut 25 with a hammer or other object (or tightening with a wrench) secures nut 25 into position. One example of a nut 25 that may be used in this aspect includes those of the variety manufactured or sold by Outinord Universal, Inc., Miami Fla., and other locations. Such nuts 25 by Outinord may be used in the framing process described previously with respect to FIG. 2A, and particularly used to secure tie-rods into position about panels 553. Washer 35 preferably has an outside diameter "d" as shown in FIG. 11 so as to maximize surface area of contact with stanchion 222 within channel 55. In an alternative aspect, nut 25 may include an integrally connected elongated neck (not shown), instead of using a washer 35.

In some non-limiting applications, a fastener 24 or coil rod may have a diameter of about ¾ or ⅞ inches (which is a common English measure for receiving a nut 25 of the Outinord variety used to secure the wall forming panels and ties). As such, distance "d" of channel 55 would then have a measure of at least the same in certain applications. Openings 26*c* and elongated slots 26*d* would also have dimensions sufficient to accommodate insertion of such a fastener. The distance "d" separating segments 52, 54 (as well as the dimension of openings or slots 26) may be varied depending upon the type of fastener 24 and/or nut 25 to be used, and vice-versa.

Figure 15:
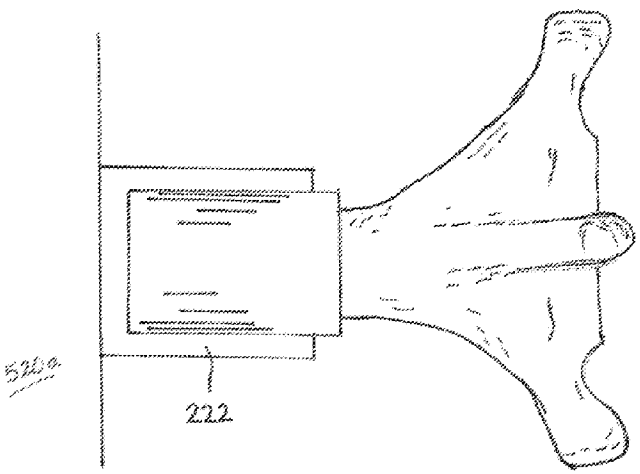
FIG. 15 is a top view of a stanchion and fastener for use with a system embodying the principles of the present invention.

FIG. 15 depicts a top view of a variation of the mechanism of FIG. 14. Here, the distance "d" of stanchion 22 is relatively small. In this aspect, fastener 24 is not visible from a top view because it does not extend beyond nut 25. A fastener 24 such as a coil rod can be selected to a length most appropriate for the wall thickness and stanchion depth so as to avoid fastener 24 from extending beyond nut 25.

Figure 16:
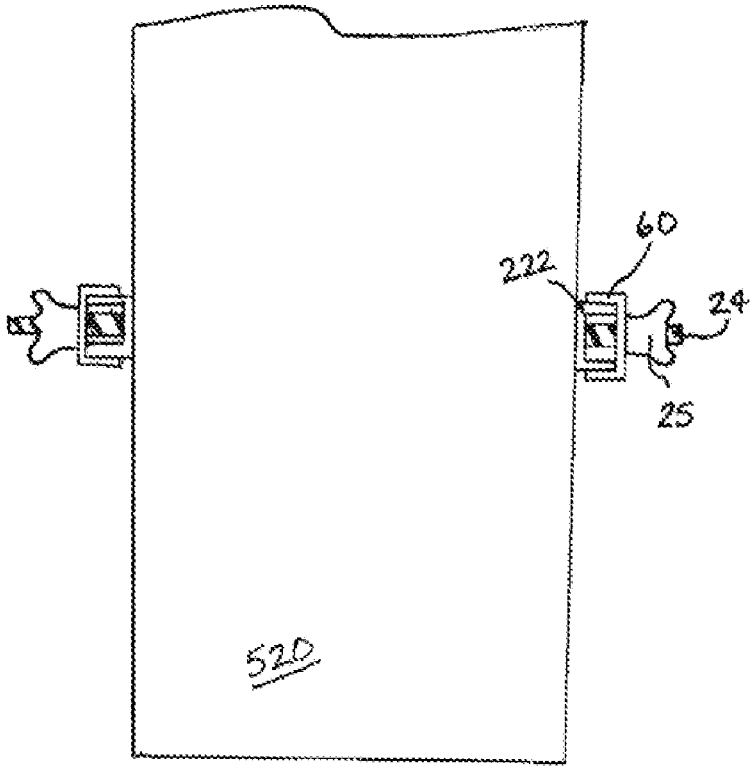
FIG. 16 is a partial top view of stanchions and fasteners for use with a system embodying the principles of the present invention.
Figure 17:
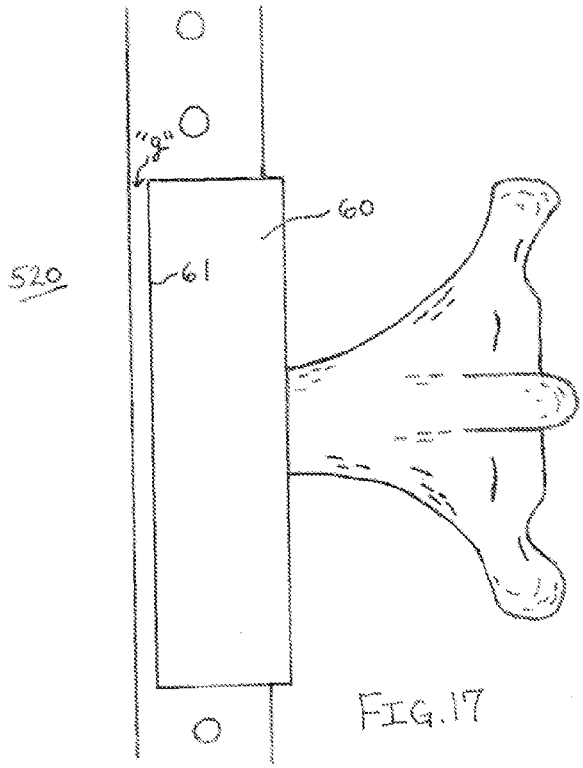
FIG. 17 is a partial side view of a stanchion and cap for use with a system embodying the principles of the present invention.

FIG. 16 depicts a partial top view of a further variation of the mechanism of FIG. 14. A fastener 24 extends through and from either side of wall 520. The mechanism includes means which abut each side of wall 520 (and in the illustrated instance, abut each of stanchions 222). Stanchion 222 is secured to wall 520 within a bay of the structure by means of a cap 60. Cap 60 overlays stanchion 222 generally as shown. As generally shown in the partial elevation view of FIG. 17, cap 60 has legs 61 such that a gap "g" remains between leg 61 and wall 520. Cap 60 includes an aperture (not shown) through which fastener 24 inserts. Nut 25 is threaded upon fastener 24 such that nut 25 abuts cap 60, in turn forcing stanchion 222 against wall 520. With such cap mechanism, a stanchion 222 having a relatively narrow channel 55 may nonetheless be firmly affixed to wall 520. Further, cap 60 provides a greater surface area for contact with stanchion 222 as opposed to having only the face 31 of nut (or washer 35) in contact with stanchion 222. Cap 60 has a generally C-shaped cross section and defines a channel in which side segments 52, 54 of stanchion insert. As cap 60 is placed over stanchion 222, cap 60 does not spin or rotate. Workers may be positioned on either side of the wall to set up the stanchions. Alternatively, and since the cap 60 prevents rotation, a single worker may set-up one side of the wall by placing fastener 24 through through-hole 577, and then move to the other side of the wall and hand-tighten nut 25 upon cap 60, and then use a hammer (or wrench) to spin the nut 25 to finally tighten the stanchion 222 to the wall. Applicants believe use of cap 60 will also provide additional strength to system 20 and allow for use of a lower gauge of material.

FIG. 18 depicts a top view of a further aspect of a fastening mechanism 70. Cap 60 includes at least one weld nut 65 welded thereto. Weld nut 65 includes threads and receives threaded fastener 24. A worker may insert fastener 24 into weld nut 65 for both weld nuts 65 if desired) and thereafter place fastener 24 through through-hole 577. Cap 60 is positioned over stanchion 222 and is prohibited from spinning, which lows a single worker to tighten the mechanism 70 by turning fastener 24 on the opposite side of wall 520. Weld nut 65*b* is located within channel of cap 60. As shown in FIG. 18, weld nut 65*b* has little tolerance to accommodate insertion of side segments 54, 56 between weld nut 65*b* and cap 60. Having a cap 60 with a greater tolerance, however, such as using a weld-nut of a smaller size, would lead to easier construction of cap 60 or easier fitting upon stanchion 222. The length of cap 60 may be varied as desired, and various sizes may be used to accommodate connection with different sizes or types of stanchions 22. As shown in FIG. 16, a cap mechanism may be used on either or both sides of wall 520. A cap 60 having a weld nut as in FIG. 18 may also be used on one side of wall 520 where a different type of fastener or nut or cap 60 may be used on the other side of the wall. As an optional feature, an additional nut 65 can be threaded onto fastener 24 and turned into tight contact with nut 65*a* for a double-nut configuration for further tightening if needed or desired.

As a further optional arrangement, nut 65*b* can instead be loose or not welded to cap 60 (or cap 60 can be eliminated in an appropriate case). A worker can simply turn a loose nut 65*b* upon fastener 24 and then place fastener 24 into opening or slot 26 of stanchion 22 and then through through-hole 576 (or place fastener 24 into through-hole 576 and then place stanchion 22 over fastener 24 and then thread nut 65*b*. Nut 65*b* fits within channel 55. Nut 65*b* is dimensioned to abut or wedge against side segments 52, 54 so that nut 65 does not turn when fastener 24 is turned. In this manner the turning of fastener 24 may further tighten (or loosen) nut 65*b* against back segment 50. Alternatively, and while not necessarily preferred due to difficulty in aligning opening 26 with a corresponding through-hole 576, nut 65*b* may be welded to back segment 50.

Figure 19:
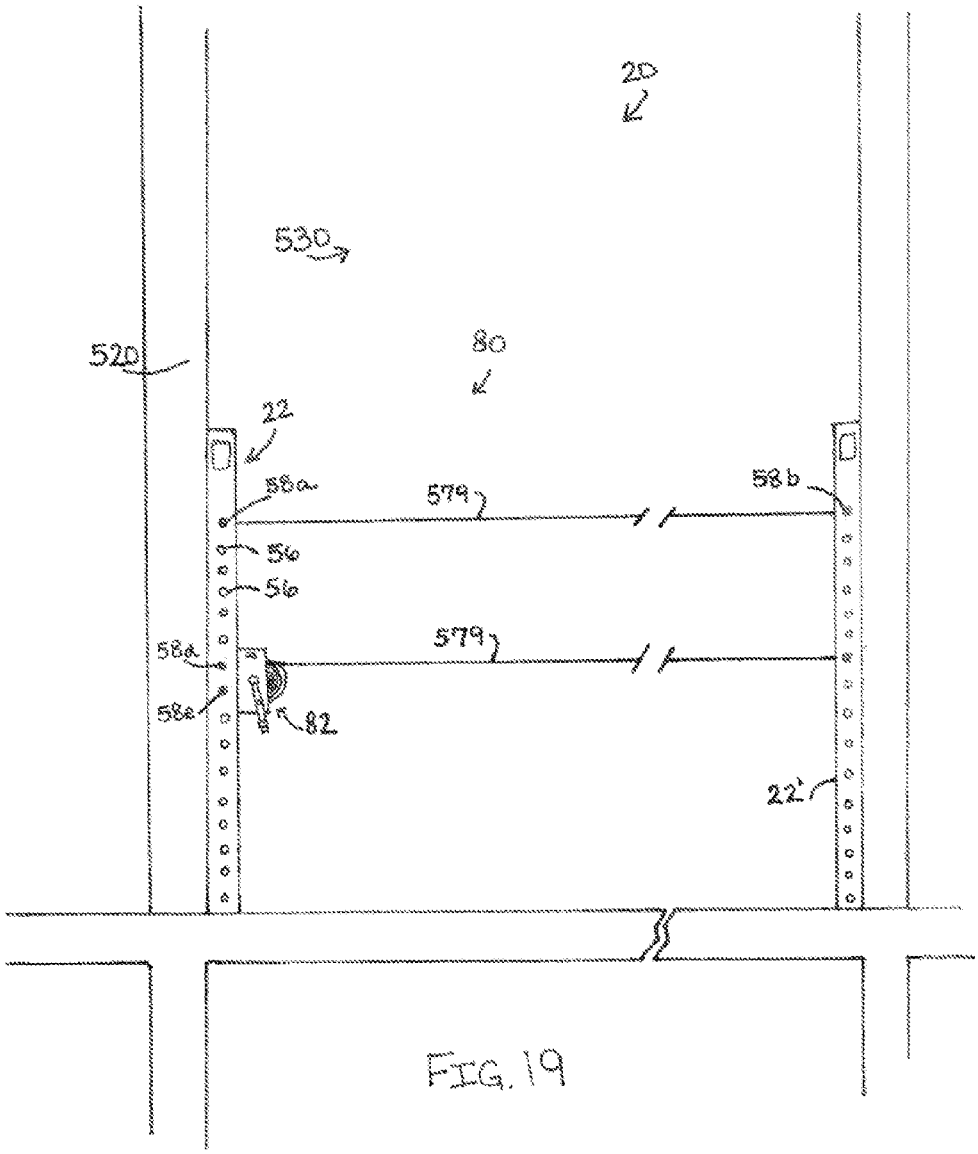
FIG. 19 is an elevation view depicting a guardrail system embodying the principles of the present invention.
Figure 20:
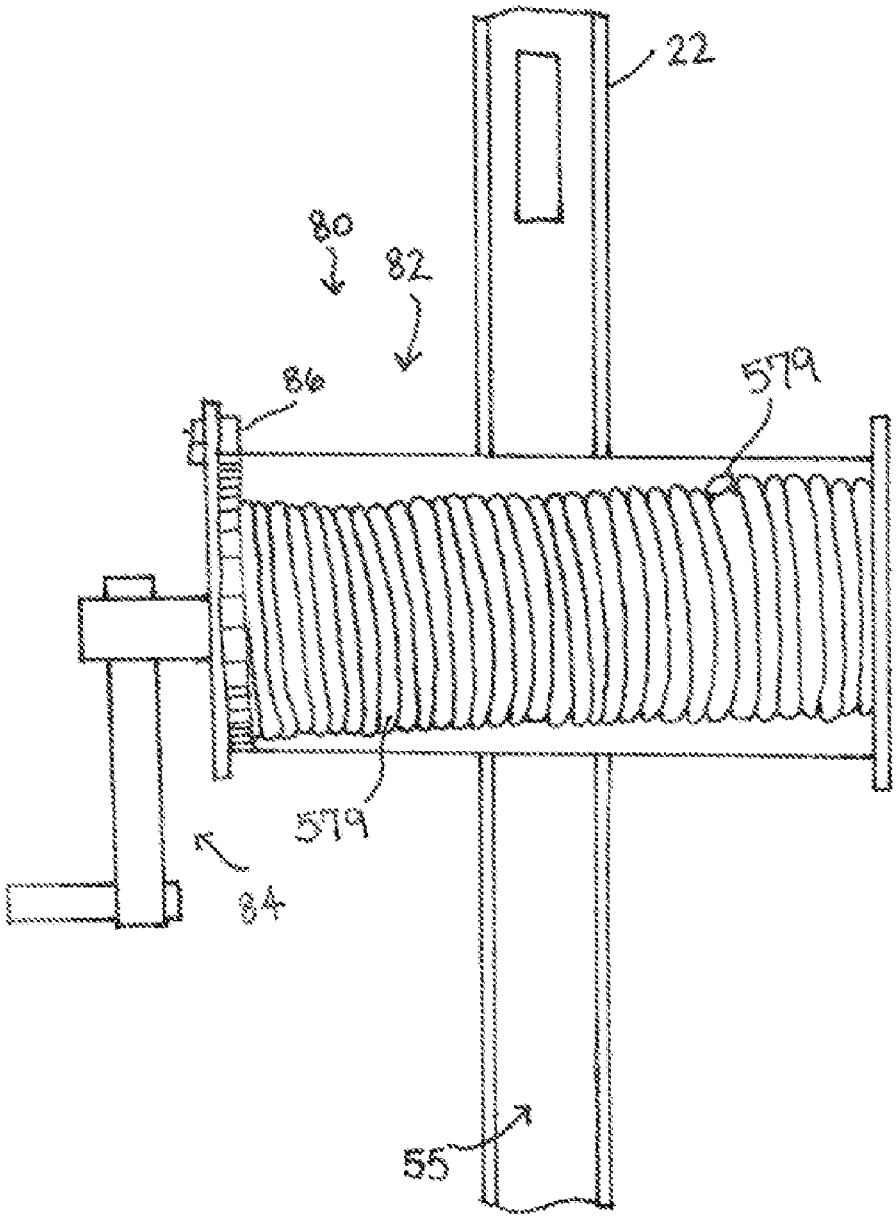
FIG. 20 is a partial end view depicting a stanchion and cable system embodying the principles of the present invention.

FIG. 19 and FIG. 20 depict a further aspect showing a cable system 80 for use in conjunction with stanchion 22. Cable system 80 includes a cable 579 which spans between walls 520*a*, 520*b* of bay 530. Cable 579 may include a cable, including but not limited to a steel cable, rope, wire, or other rope-like structure. One end of cable 579 is connected to stanchion 22. Cable 579 is lead across bay 530 and around stanchion 22', returning to connect again to stanchion 22. Preferably, stanchion 22 and 22' are of the variety described above as stanchion 222. Preferably cable 579 connects to a rail fastener 58 such as a pin 58*a* which is inserted into stanchion 22. Cable 579 then passes over pin 58*b* and then downward to pin 58, returning back to stanchion 22. As such, both a top "rail" and middle "rail" are provided with the cable system 80. Various other arrangements or alignments may be used as desired. Instead of (or in addition to) using pins 58, system 80 may include pulleys to accommodate for more efficient tightening and better wear of components. Preferably a winch 82 having a spool (and optional crank 84) for winding cable 579 is affixed to stanchion 22. An alternative nut may be included so that spool may be rotated with a wrench or ratchet if desired. Pins 58*d*, 58*e* may be used to secure winch 82 to stanchion 22. Winch 82 may include a mount (not shown) which inserts into channel 50 or about stanchion 22 for secure mounting to stanchion 22. A user may tighten cable 579 by turning crank 84. A lock 86 may engage or ratchet with teeth of a spool gear to secure a tight winding of cable 579. A user may tighten cable 579 to minimize sag. For additional support, winch 82 may also be configured to abut against wall 520. Use of system 80 allows for fast set-up or take-down of a standard rail system. No measuring of railings is required, and no damage to the structure occurs. Bays of various lengths may be spanned with safety cable 579. Cable 579 may be positioned at different heights by selecting a variety of adjustment ports 56 for positioning of pins 58 or pulleys (pulleys not shown). Cable 579 may also span across bay 530 multiple instances. Alternatively, winch 82 may be positioned within channel 55 of stanchion 222. A user may quickly take-down the cabling 579 from bay 530 without disrupting work at adjacent bays. Various alternative winding or winch mechanisms or cabling systems may be used without departing from the spirit of the invention.

It will thus be appreciated that those skilled in the art will be able to devise numerous alternative arrangements that, while not shown or described herein, embody the principles of the invention and thus are within its spirit and scope.

What is claimed is:

1. A method of affixing a construction guardrail stanchion to a concrete wall having a first side and a second side and formed by pouring concrete into a wall form that is removed after the concrete is hardened, the method comprising:

utilizing a tie-hole extending from the first side to the second side of the concrete wall of a structure to affix a construction guardrail stanchion to the concrete wall inside a bay of the structure, said tie-hole resulting from removal of a tie extending from the first side to the second side of the concrete wall when removing the wall form; and attaching the construction guardrail stanchion to the wall during construction of the structure by utilizing the tie-hole.

2. The method of claim 1 where the wall includes at least two through-holes, the stanchion includes at least two elongated slots, each slot capable of receiving a fastener which extends through a corresponding through-hole.

3. The method of claim 1 where another stanchion is affixed to another wall, the another wall positioned opposite the concrete wall, a guardrail affixed to and extending from the stanchion to the another stanchion within the bay.

4. The method of claim 1 where the stanchion is adapted to receive at least three guardrails.

5. The method of claim 1 further comprising affixing a guardrail to the stanchion.

6. The method of claim 5 where the guardrail is removed and then reset.

7. The method of claim 1 further comprising means for affixing the stanchion to the wall by utilizing the through-hole.

8. The method of claim 7 where the through-hole is a tie-hole and the means for affixing includes a fastener inserted into the tie-hole.

9. The method of claim 1 comprising affixing a cable to the stanchion.

10. The method of claim 9 where the cable is taken down and then reset.

11. The method of claim 1 where the stanchion includes a cable winding mechanism.

12. The method of claim 1 where the stanchion is removed.

13. The method of claim 1 where a life-line is clipped to the stanchion.

14. The method of claim 1 where the stanchion is affixed adjacent an edge of the structure.

15. The method of claim 1 where the stanchion is made of wood.

16. The method of claim 1 where the stanchion is made of metal.

17. A method comprising:

utilizing a through-hole of a concrete wall of a structure to affix a construction guardrail stanchion to the concrete wall inside a bay of the structure where said through-hole is a tie-hole extending from a first side to a second side of the concrete wall, the tie-hole resulting from removal of a tie when removing a wall form; and affixing the construction guardrail stanchion to the wall during construction of the structure, said utilizing a through-hole includes insertion of a fastener all of the way through the tie-hole.

18. The method of claim 17 where the tie-hole is a taper tie-hole.

19. The method of claim 18 where said fastener includes a threaded pin and a corresponding nut.

20. The method of claim 17 where the stanchion is removed after construction of the bay of the structure.

21. The method of claim 17 where a life-line is clipped to the stanchion.

22. A method of guarding against accidental falls on a construction site, said method comprising:

utilizing a first through-hole formed through a wall and extending from a first side of the wall to a second side of the wall, said through-hole being a tie-hole resulting from removing a tie from a wallform; and inserting a first fastener through a first construction guardrail stanchion and all the way through the tie-hole to affix the construction stanchion to the wall during construction.

23. The method of claim 22, further comprising:

attaching a nut to the first fastener.

24. The method of claim 23, further comprising:

said inserting step includes inserting the first fastener through the first stanchion, into the first through-hole and through a second stanchion; and where the attached nut engages the second stanchion.

25. The method of claim 24, further comprising:

where the wall has a first side and a second side;

abutting the first stanchion with the first side of the wall; and abutting the second stanchion with the second side of the wall.

26. The method of claim 22, further comprising:

inserting a second fastener through the first stanchion, into a second through-hole and through the second stanchion.

27. The method of claim 22 where the construction stanchion is affixed in a bay of the construction site.

28. The method of claim 22 where the stanchion is of a generally C-channel variety and includes a plurality of adjustment ports.

29. The method of claim 22 further comprising a guardrail support connected to the stanchion.

30. The method of claim 22 where the stanchion is removed after construction of the construction site.

31. The method of claim 22 where a life-line is used in conjunction with the method.

32. The method of claim 31 where the life-line is clipped to the stanchion.

* * * * *